US011974655B2

(12) United States Patent
Zadok

(10) Patent No.: US 11,974,655 B2
(45) Date of Patent: May 7, 2024

(54) BEER PUPPET

(71) Applicant: Avi Zadok, Hollywood, FL (US)

(72) Inventor: Avi Zadok, Hollywood, FL (US)

( * ) Notice: Subject to any disclaimer, the term of this patent is extended or adjusted under 35 U.S.C. 154(b) by 367 days.

(21) Appl. No.: 17/324,389

(22) Filed: May 19, 2021

(65) Prior Publication Data

US 2022/0369795 A1 Nov. 24, 2022

(51) Int. Cl.

*A45F 3/08* (2006.01)
*A45F 3/04* (2006.01)
*A45F 3/16* (2006.01)

(52) U.S. Cl.

CPC ..... *A45F 3/08* (2013.01); *A45F 3/16* (2013.01); *A45F 2003/045* (2013.01); *A45F 2003/166* (2013.01); *A45F 2200/0583* (2013.01)

(58) Field of Classification Search

CPC ..... A45F 3/08; A45F 3/16; A45F 2003/045; A45F 2003/166; A45F 2200/0583
USPC ..... 222/175; 446/28
See application file for complete search history.

(56) References Cited

U.S. PATENT DOCUMENTS 1,676,424 A * 7/1928 Carr ..... F16N 3/12 417/229
3,140,800 A * 7/1964 Henderson ..... A01C 7/02 222/196
5,425,614 A * 6/1995 Perussi ..... B67D 3/0029 141/351
2007/0012733 A1* 1/2007 Horito ..... A47G 21/185 224/148.2
2022/0369795 A1* 11/2022 Zadok ..... A45F 3/08

OTHER PUBLICATIONS

"Beer Puppeteer." YouTube, uploaded by The Grahek Adventure, Jul. 11, 2019, www.youtube.com/ watch?v=yGtJ296E5lc.*

* cited by examiner

*Primary Examiner* — Paul R Durand
*Assistant Examiner* — Michael J. Melaragno
(74) *Attorney, Agent, or Firm* — The Roy Gross Law Firm, LLC; Roy Gross

(57) ABSTRACT

Described herein is a beverage carrying assembly, comprising: a backpack adapted to be worn by a user; a frame, the frame comprising: a first portion to be affixed to the backpack; and a second portion that projects over the head of the user; a platform adapted to carry a beverage container; and a pulley assembly adapted to manipulate a position of the platform with respect to the user and frame.

13 Claims, 16 Drawing Sheets

BEER PUPPET

FILED OF THE INVENTION

The embodiments described herein relate generally to marketing and advertising devices, and more specifically to systems, methods, and modes for marketing and advertising adult beverages through the use of a mechanical beverage drinking assembly according to aspects of the embodiments.

BACKGROUND OF THE INVENTION

The U.S. beer industry employs over two million Americans and is valued at about $114.2 billion dollars. Beer consumption per capita is even higher in most European countries. A number of beer accessories have been created to increase the fun and social aspect of beer culture.

Nonetheless, competition between "macro" breweries (the large, more established producers of beer (e.g., Anheuser-Busch®, among many others) and between "micro" breweries, and between the two types of breweries, is extremely competitive. One need only to watch a televised sporting event, such as any National Football League® (NFL) football game, Major League Baseball® (MLB) baseball game, and/or National Hockey League® (NHL) hockey game, to understand and appreciate how competitive the industry is. Most manufacturers of beer strive in their television and/or printed advertisements to show that consuming beer is fun, social, and entertaining. In addition to the many advertisements, and equally numerous places to purchase beer, there are many thousands of beer festivals and related events around the world. Breweries are therefore always looking for better methods of advertising and promoting their products over their competitors'. Thus, breweries constantly look for products and devices that can increase the enjoyment of the drinking the beer, and interesting and exciting such products and devices are greatly valued. At those of skill in the art can appreciate, these products and devices need to be portable, robust, novel, and entertaining.

Accordingly, a need has arisen for systems, methods, and modes for marketing and advertising adult beverages through the use of a mechanical beverage drinking assembly according to aspects of the embodiments.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for marketing and advertising adult beverages through the use of a mechanical beverage drinking assembly according to aspects of the embodiments that will obviate or minimize problems of the type previously described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

According to a first aspect of the embodiments, a beverage carrying assembly is provided herein, the beverage carrying assembly comprising: a backpack adapted to be worn by a user; a frame, the frame comprising: a first portion to be affixed to the backpack; and a second portion that projects over the head of the user; a platform adapted to carry a beverage container; and a pulley assembly adapted to manipulate a position of the platform with respect to the user and frame.

According to the first aspect of the embodiments, the platform is adapted to retain a beverage container.

According to the first aspect of the embodiments, the beverage is an alcoholic beverage.

According to the first aspect of the embodiments, the platform is substantially planar with a hole adapted to retain the beverage container.

According to the first aspect of the embodiments, the platform comprises: a back portion; and two or more curved rods, each of which is curved to substantially match a shape of the beverage container, and opposedly attached to the back portion via respective springs such that each of the curved rods can be pulled away from each other, the beverage container located therebetween, and the curved rods released to secure the beverage container between the curved rods.

According to the first aspect of the embodiments, the backpack comprises: a back portion that, when the backpack is worn by the user, is adjacent to a back of the user; a pair of shoulder straps; and a waist strap, the shoulder straps and waist strap adapted to retain the backpack to an upper torso of the user.

According to the first aspect of the embodiments, the first portion of the frame comprises a first member affixed to a rear surface of the back portion of the backpack and is adapted to be substantially vertical, and further wherein the second portion of the frame comprises a second member affixed to the first member and is substantially orthogonal to the first member and extends over a head of the user.

According to the first aspect of the embodiments, the frame is adapted to be changeable between a stored condition and an extended condition.

According to the first aspect of the embodiments, the second member is rotatingly attached to a second end of the first member at a first end of the second member.

According to the first aspect of the embodiments, the second member is adapted to rotate about the first member between the stored condition and the extended condition, and when in the stored condition, the second member is in substantial alignment with the first member, and further wherein, when the first and second member are in substantial alignment with each other, the first and second member can be secured to the back portion of the backpack.

According to the first aspect of the embodiments, the pulley assembly is adapted to be stored within the second member, and the pulley assembly is adapted to be retained when stored within the second member by a retaining mechanism.

According to the first aspect of the embodiments, wherein the retaining mechanism comprises: a plastic hook and loop device.

According to the first aspect of the embodiments, wherein the first member comprises: an upper portion; a lower portion; a rotation stop bar located at a first end of the upper portion; a pivot bar adapted to affix the first member to the second member, and is further adapted to facilitate rotation of the second member about the first member, and wherein the rotation stop bar prevents rotation of the second member about the first member when the second member is substantially orthogonal to the first member; a first and second slide channel in the lower portion; a first and second sliding slide bar in the upper portion adapted to fit through the first and second slide channel in the lower portion, such that the upper portion can slide up and down the lower portion.

According to the first aspect of the embodiments, wherein the first member comprises: an upper portion comprising a plurality of upper portion holes, substantially aligned with each other; a lower portion adapted to slidingly engage within the upper portion, the lower portion comprising: a button hole, in substantial alignment with the plurality of upper portion holes; a spring loaded button assembly affixed to an inner wall opposite to that of the button hole, the button hole adapted to allow a button portion of the spring loaded button assembly to move in and out through the button hole as a user pushes against a spring of the spring loaded button assembly and stops pushing against the spring, and wherein the button can move in and out of any one of the upper portion holes when the upper portion and lower portion are moved relative to each other so that any one of the upper portion holes is in substantial alignment with the button hole, and when the button extends through a first upper portion hole and button hole, the upper portion and lower portion are substantially but releasably fixed in position with respect to each other, and when the button is pushed through the aligned upper portion hole and button hole, the upper and lower portions can be moved relative to each other.

According to the first aspect of the embodiments, wherein the pulley assembly comprises: a first and second handle; a first cable attached to the first handle at a first end of the first cable and a first end of the first handle; a second cable attached to the first handle at a first end of the second cable and a second end of the first handle; a third cable attached to the second handle at a first end of the third cable and a first end of the second handle; a fourth cable attached to the second handle at a first end of the fourth cable and a second end of the second handle; a first pulley bar attached to the second member; a second pulley bar attached to the second member; a first pulley device attached to a first end of the first pulley bar; a second pulley device attached to a first end of the second pulley bar; a third pulley device attached to a second end of the first pulley bar; and a fourth pulley device attached to a second end of the second pulley bar, and wherein the first cable passes through the first pulley device and is attached to the platform at a second end of the first cable, the second cable passes through the second pulley device and is attached to the platform at a second end of the second cable, the third cable passes through the third pulley device and is attached to the platform at a second end of the third cable, and the fourth cable passes through the fourth pulley device and is attached to the platform at a second end of the fourth cable.

According to the first aspect of the embodiments, wherein the pulley assembly is further adapted to change a height of the platform, and is still further adapted to tilt the platform at substantially any angle between about 0° and about 180°, and in substantially any direction.

According to a second aspect of the embodiments, a method for using a beverage carrying assembly is provided, the method comprising: inserting a beverage container into a platform of the beverage carrying assembly; filling the beverage container with a beverage; moving the platform to a position that is substantially level with a mouth of a user; and manipulating the platform such that the beverage container tilts to dispense the beverage into the mouth of the user.

According to the second aspect of the embodiments, the method further comprises: donning the beverage carrying assembly when in a fully extended condition onto an upper torso of the user, such that the platform is substantially orthogonal to a chest of the user.

According to the second aspect of the embodiments, the method further comprises: removing the beverage carrying assembly from the body of the user; and putting the beverage carrying assembly into a storage condition such that the beverage carrying assembly is folded and secured to a backpack adapted to carry the beverage carrying assembly.

According to the second aspect of the embodiments, the step of manipulating comprises: moving a first and/or second handle that manipulates the platform such that a height of the platform change, a tilt angle changes, and/or a tilt orientation changes.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

DETAILED DESCRIPTION OF THE INVENTION

Figure 1:
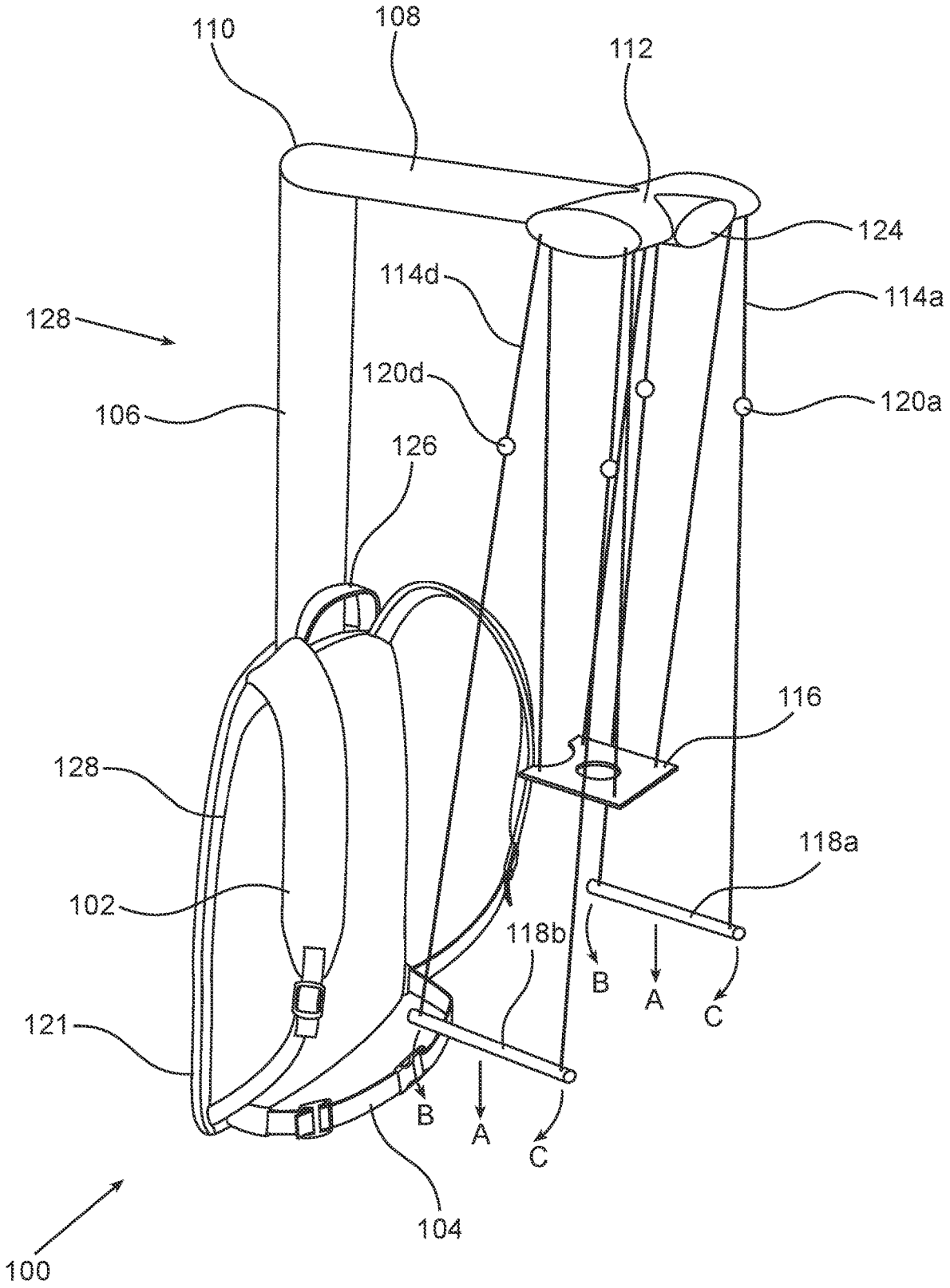
FIG. 1 illustrates a rear side view of a portable crane assembly (crane assembly) adapted to operate as a mechanical adult beverage serving assembly according to aspects of the embodiments.

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a marketing and/or advertising agency or company, so it is to be understood that generally the concepts discussed herein are applicable to various subsystems and not limited to only a particular controlled device or class of devices, such as a beer marketing/advertising device.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

100 Portable Crane Assembly (Crane Assembly)
102 Shoulder Straps
104 Waist Strap
106 Vertical Member
108 Horizontal Member
110 Hinge Assembly
112 Head Piece
114 String/Cable
116 Platform
118 Handle
120 String Stop
121 Backpack Storage Area
122 Backpack Portion
124 Head Piece Logo Plate (Logo Plate)
126 Backpack Handle (Handle)
128 Crane Portion
402 Main Logo Plate
502 Joining Component
504 Threaded Bolt
506 Threaded Bolt Sleeve
508 Hinge Tube
510 Vertical Member Bolt Holes
512 Joining Component Bolt Holes
600 Telescoping Mast Assembly (Mast Assembly)
602*a* Lower Mast
602*b* Upper Mast
604 Spring-loaded Button Assembly (Button Assembly)
606 Button Locking Holes
702 Button
704 Spring
706 Button Post (Post)
708 Inner Wall Lower Mast
710 Inner Wall Upper Mast
712 Outer Wall Lower Mast
800 Beverage Container Grasping Mechanism (Grasping Mechanism)
802 Beverage Container
804 Grasping Member
806 Spring Hinges
808 Back Portion of Grasping Mechanism (Back Portion)
900 Portable Crane Assembly (Crane Assembly)
902 Shoulder Straps
904 Waist Strap
906 Vertical Member Assembly
908 Horizontal Member Assembly (Horizontal Member)
910 Hinge Assembly
912 Head Piece Assembly (Head Piece)
914 String/Cable (Cable)
916 Platform
918 Handle
920 String Stop
922 Pulley Bar
924 Pulley Device
926 Securing Mechanism (Spring Loaded Plunger)
930 Crane Portion
940 Backpack Portion
1402 Upper Vertical Member
1404 Lower Vertical Member
1408 Lower Vertical Member Securing Hole
1410 Retaining Mechanism
1412 Logo Plate
1414 Slide Bar
1416 Slide Channel(s)
1418 Rotation Stop Bar
1420 First Set of Rotating Holes
1422 Second Set of Rotating Holes
1424 Upper Vertical Member Securing Holes
1602 String/Cable Holes
1604 Beverage Container Hole
1700 Method of Using Crane Assembly 100, 900
1702-1708 Method Steps of Method 1700

List of Acronyms Used in the Specification in Alphabetical Order

MLB Major League Baseball
NFL National Football League
NHL National Hockey League The different aspects of the embodiments described herein pertain to the context of systems, methods, and modes for marketing and advertising beer and/or other adult beverages through the use of a mechanical drinking assembly according to aspects of the embodiments, but is not limited thereto, except as may be set forth expressly in the appended claims.

Aspects of the embodiments are directed towards a small portable crane assembly (crane assembly) 100, 900 that can be deployed from a backpack. The user wears the backpack, and a crane portion cantilevers over the top of the head and shoulders of the user to hang in front of the user. A plurality of strings hang down from the end of the crane portion. Connected to the strings is a platform that can be specially designed to hold a container, which can contain beer or another beverage. The strings pass through a head portion of the crane portion, and can slide freely (there can be one or more bearing assemblies that facilitate movement of the strings). At the opposite end of the strings are two handles that can be used to manipulate the position of the platform. The user can manipulate the handles to bring the platform to their mouth so that they can drink the beer (or other adult/alcoholic beverage, or soda, or any beverage) resting on the platform. The platform can also be embodied as a spring-loaded grasping assembly that can be designed to grasp a plastic container or a glass/plastic bottle that contains the beverage. Aspects of the embodiments turn drinking a beer into a fun challenge that requires hand eye coordination and practice, and an advertising/marketing opportunity.

According to aspects of the embodiments, crane assembly 100, 900 deploys from a backpack with shoulder straps and a waist strap. A vertical member passes through the top of the backpack and connects to a horizontal member via a hinge (or pivot member). The horizontal member cantilevers over the top of the head and shoulders of the user. At the end of the horizontal member is a head piece that supports the strings and provides for their passage there-through. The strings can pass through the head piece and can slide substantially freely. Hanging from the end of the strings substantially directly below the head piece is a beer holding platform. The beer holding platform is adapted to securely hold at least one beer. At the opposite ends of the strings are two handles that can be pulled to manipulate the position of the platform. Stops on each of the strings prevent them from passing too far through the head piece. The joint between the vertical member and the horizontal member is hinge that allows the vertical member and horizontal member to hinge or pivot about each other.

Figure 17:
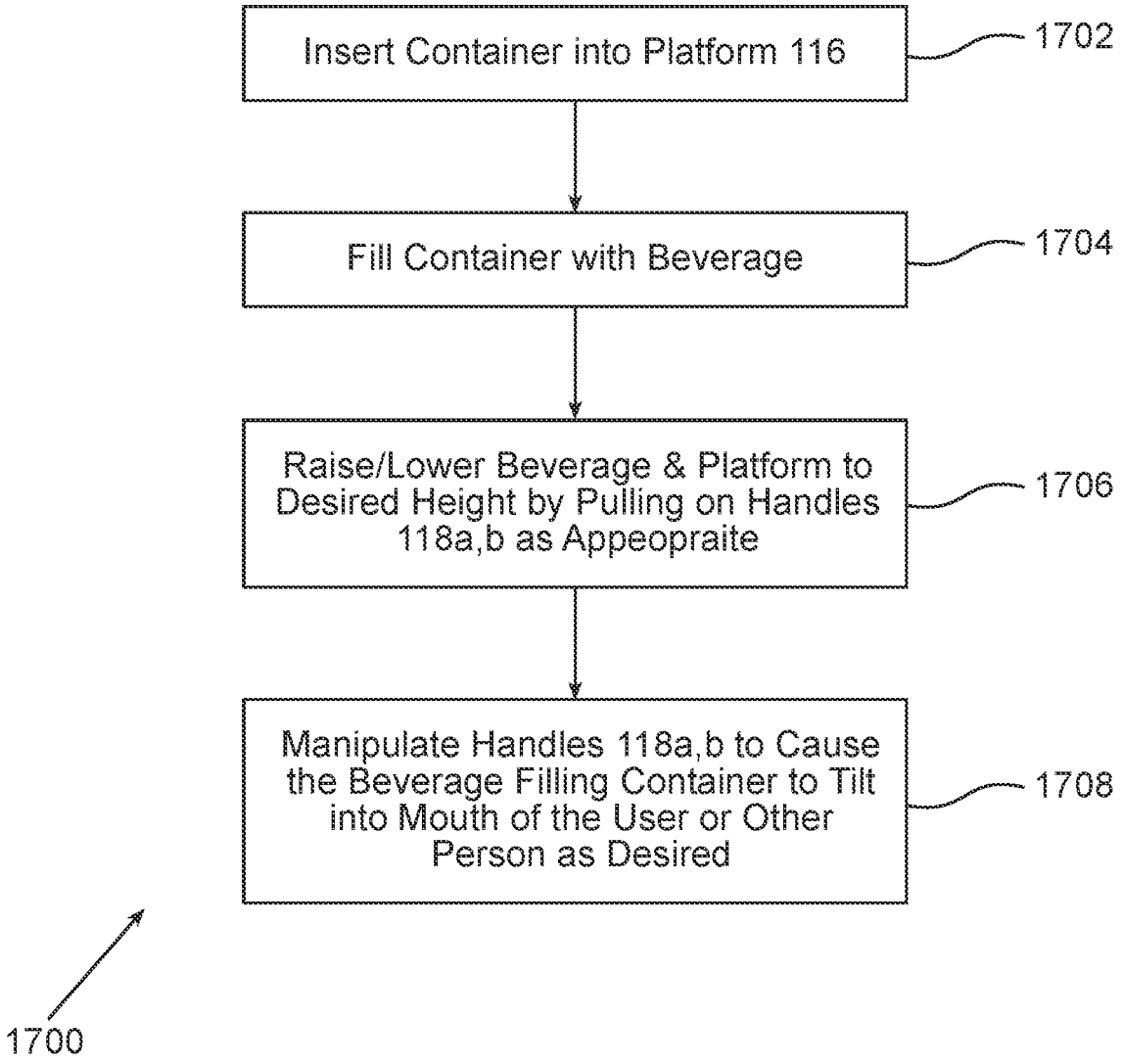
FIG. 17 is a flow chart of a method for using the crane as shown in FIGS. 1-16 according to aspects of the embodiments.

According to aspects of the embodiments, crane assembly 100, 900 folds for storage and transport. The vertical member can be height adjustable via a pin and lock system, among other types of height adjustable-retention means. Although not shown in the Figures, either or both of crane assemblies 100, 900 could be composed of a single unitary member that is attached to a backpack to be worn by the user, with all or most of the remaining components as needed to functionally operate in the manner described below, and in regard to method 1700 as shown in FIG. 17, discussed in greater detail below.

FIG. 1 illustrates a rear side view of portable crane assembly (crane assembly) 100 according to aspects of the embodiments. Crane assembly 100 comprises backpack portion 122 can crane portion 128. Backpack portion 122 comprises backpack storage area 121, shoulder straps 102, waist strap 104, and handle 126, among other components, described below. Crane portion 128 comprises vertical member 106, horizontal member 108, hinge assembly 110, head piece 112, strings/cables 114, platform 116, handles 118, string stops 120, and logo plate 124, among other components, described below.

Handles 118 can be manipulated to raise and lower platform 116 according to aspects of the embodiments. For example, if a user pulls down handles 118*a,b* in the direction of arrows A as shown in FIG. 1, platform 116 is raised along with whatever container might be in platform 116, along with its contents. Once the top of the container is at or about the same height as the mouth of the user, the user can pull either or both of handles 118*a,b* in the direction of Arrows B so that the container is tilted into the mouth of the user. Alternatively, if the user were to pull handles 118*a,b* in the direction of Arrows C, the user could spill the contents of the container into the mouth of a person standing in front of the user, or some other container. By way of a further non-limiting example, the user could raise (or lower) platform 116 to a desired height, and pull-down handle 118*b* in the direction of Arrow A so that the container is tilted to the right of the user, and visa-versa pull down handle 118*a* so that the container is tilted to the left of the user. Substantially any angle of tilt can be accomplished by the appropriate application of downward force on one or both of handles 118*a,b*, according to aspects of the embodiments. According to aspects of the embodiments, the user can tilt platform 116 at substantially any angle between about 0° and about 180°. Thus, the user can manipulate handles 118*a,b* to control movement of platform 116 much like a marionettist would do with a marionette.

Figure 2:
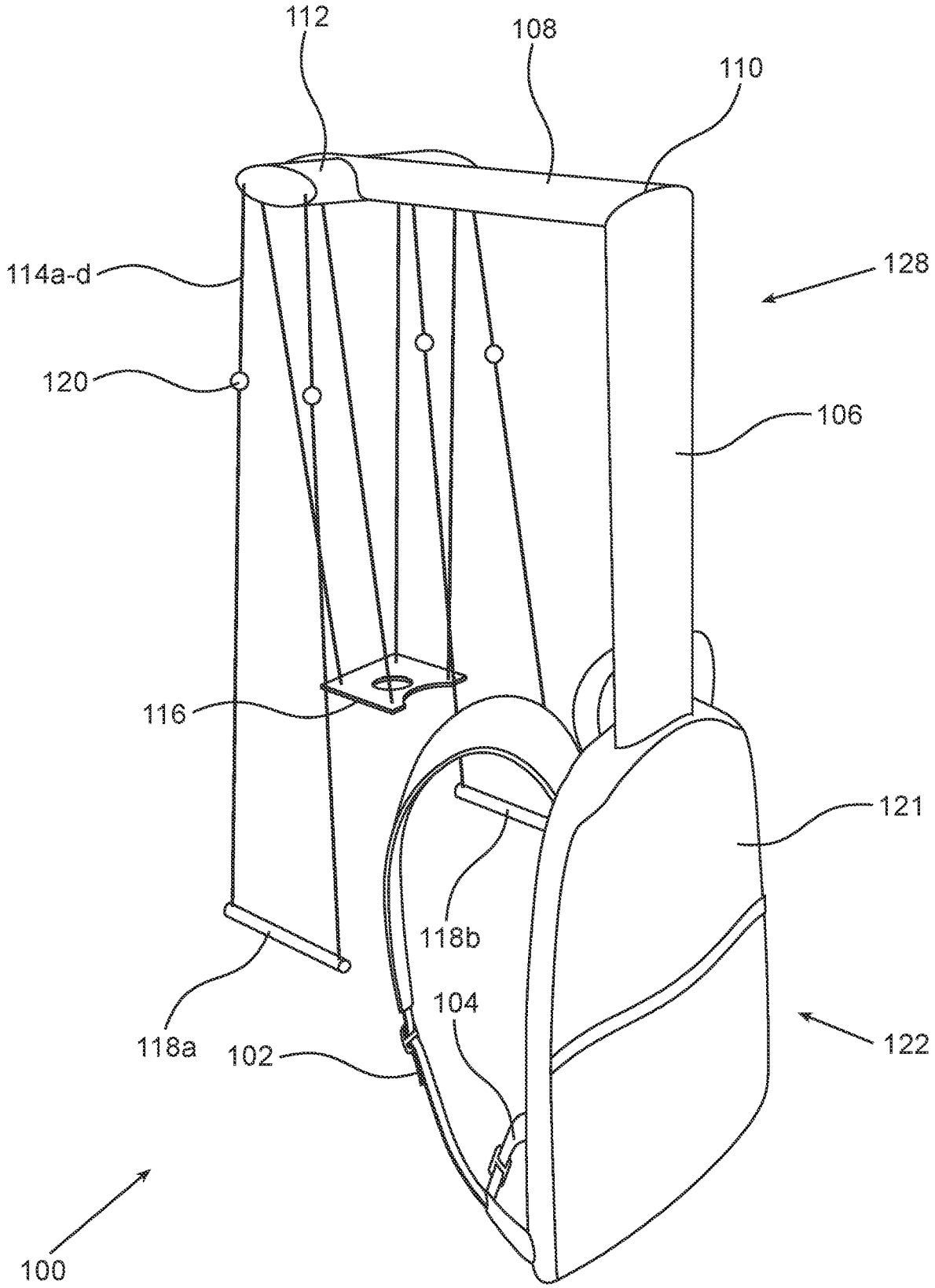
FIG. 2 illustrates a front side view of the crane assembly shown in FIG. 1 according to aspects of the embodiments.
Figure 8A:
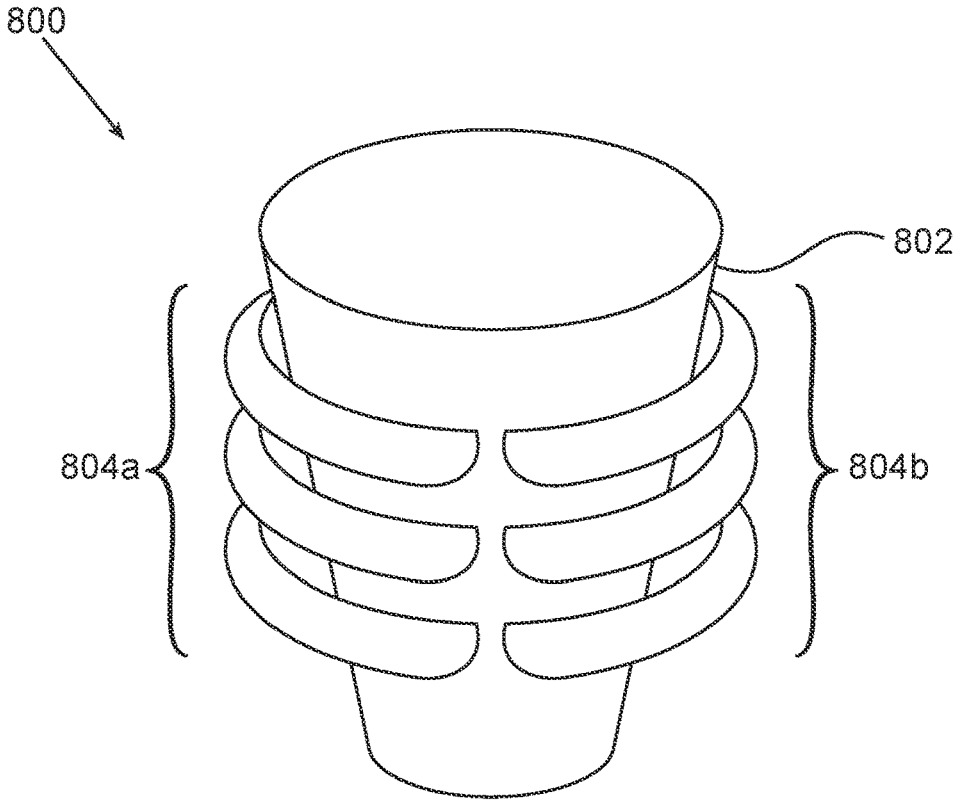
FIGS. 8A and 8B illustrate a grasping mechanism that can used in place of the platform shown in FIGS. 1 and 2 for retaining a beverage filled container according to aspects of the embodiments.
Figure 8B:
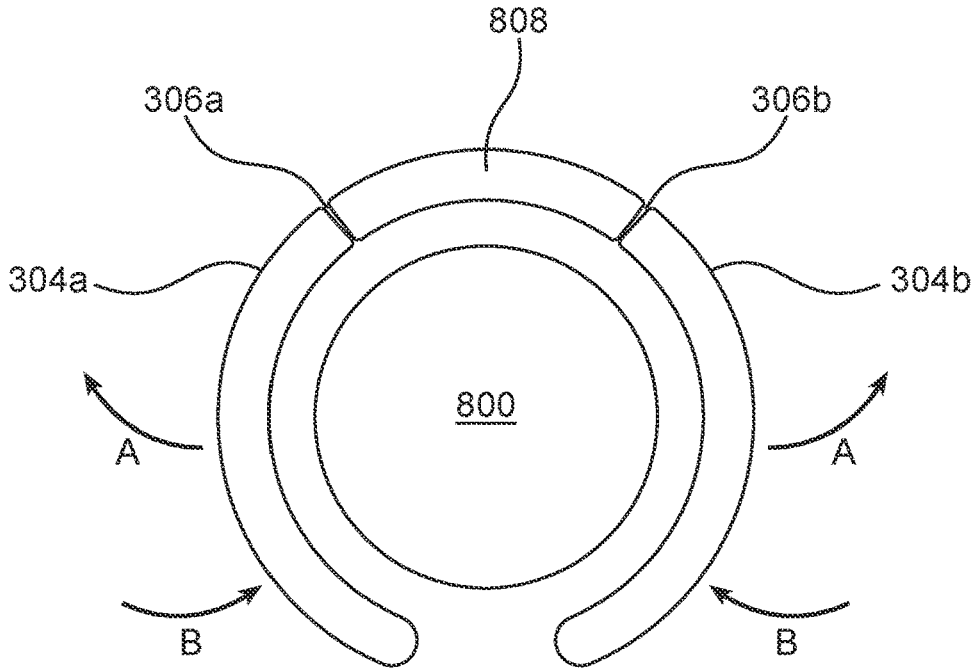

FIGS. 8A and 8B illustrate beverage container grasping mechanism 800 that can used in place of platform 116 shown in FIGS. 1 and 2 for retaining a beverage filled container 802 according to aspects of the embodiments. According to further aspects of the embodiments, platform 116 can be replaced by grasping mechanism (spring loaded) 800 that can latch onto container 802, or bottle, or some other beverage filled container. The user can manipulate grasping mechanism 800 embodiment of platform 116 in a substantially similar manner as can be original platform 116. Grasping mechanism 800 comprises back portion 808, a first set of grasping members 804*a*, a second set of grasping members 804*b*, and first and second hinges 806*a,b*, which attach first and second grasping members 804*a,b* to back portion 808 in a spring loaded and releasable manner. In use, grasping members 804*a,b* are normally closed, and the spring hinges 806*a,b* can be rotated such that the grasping members 804*a,b* are pulled apart/open (in the direction of Arrows A) to allow insertion of container 802 therebetween, and then released such that grasping members 804*a,b* move in the direction of Arrows B to grasp container 802 according to aspects of the embodiments. According to further aspects of the embodiments, grasping mechanism 800 can be manufactured as a unitary device, i.e., from a plastic, with a built-in spring/flexibility in grasping mechanisms 804, so that there is no need for assembly and/or spring hinges 806.

Referring back to FIG. 1, crane portion 128 deploys from backpack portion 122 according to aspects of the embodiments. Vertical member 106 extends from an interior portion of backpack storage area 121, and passes through the top of backpack portion 121 and connects to horizontal member 108 via hinge assembly 110 at a second end of vertical member 106. Horizontal member 108 cantilevers over the top of the head and shoulders of the user. At a second end of horizontal member 108 is head piece 112 that supports a plurality of strings/cables 114*a-d*. Strings/cables 114*a-d* pass through head piece 112 and can slide substantially freely through head piece 112. One or more bearings (not shown) or similar assembly can be used to facilitate the movement of strings/cables 114*a-d* through head piece 112. Attached to a first end of strings/cables 114*a-d*, substantially directly below head piece 112, is platform 116. Platform 116 is specially designed to securely hold a container (not shown in FIG. 1). The container can be a bottle, can, or open cup, and can contain a beverage, such as beer. Attached to a second end of strings/cables 114*a-d* are first and second handles 118*a,b* that can be pulled to manipulate the position of platform 116—i.e., to raise, lower, and/or tilt platform 116. Located on one or more of strings/cables 114*a-d* are stops 120 that prevent them from passing too far through head piece 112.

Located at a junction of a first end of horizontal member 108 and the second end of vertical member 106 is hinge assembly 110. Hinge assembly 110 hingedly joins vertical member 106 and horizontal member 108 together. Crane portion 128 is adapted to fold for storage and transport through use of hinge assembly 110 according to aspects of the embodiments; i.e., hinge assembly 110 can be locked such that vertical member 106 is substantially orthogonal to horizontal member 108 according to aspects of the embodiments. [[Q: How does hinge assembly 110 lock??]] Vertical member 106 can also be height adjustable via a pin and lock system, among other types of releasably securing mechanisms.

Figure 3:
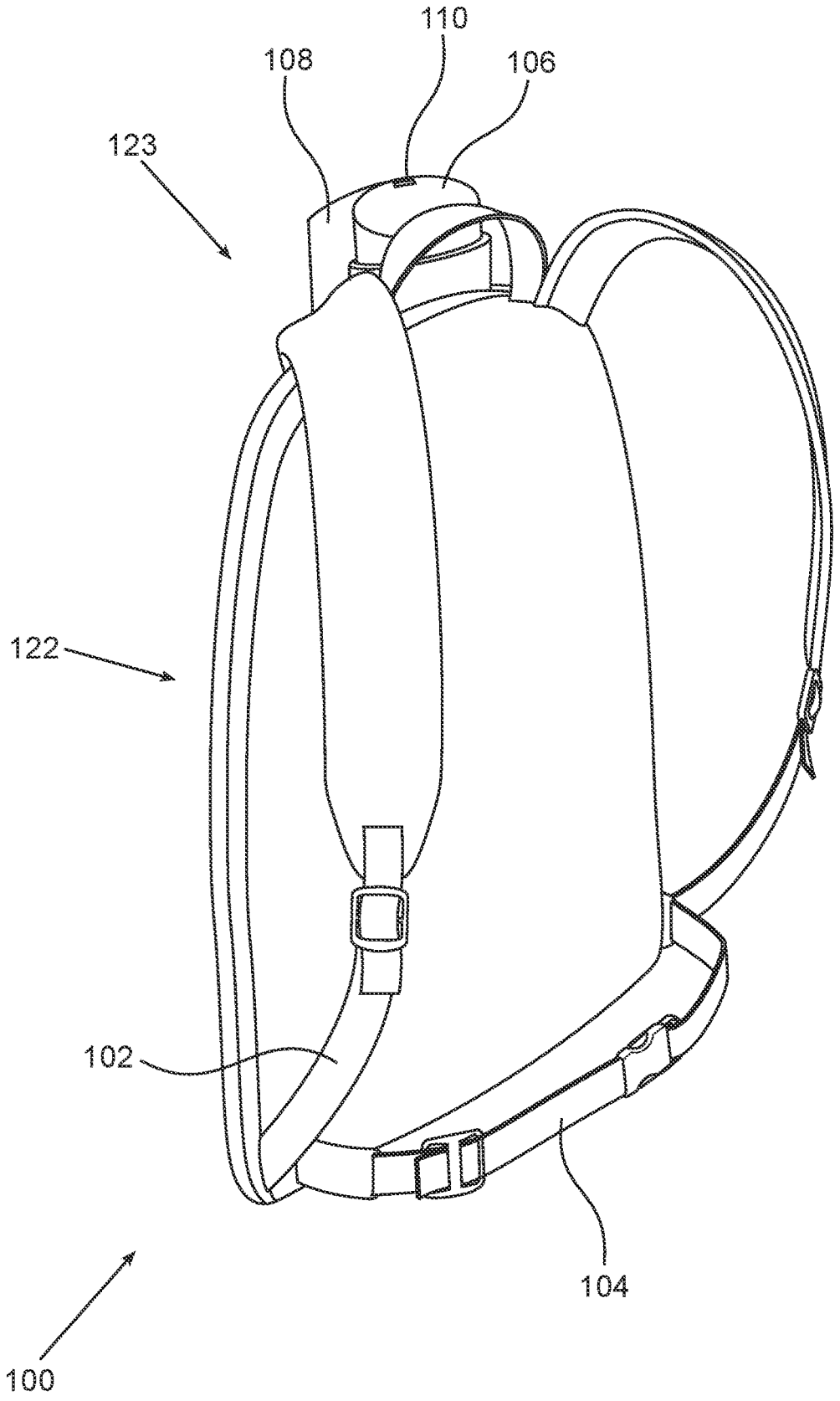
FIG. 3 illustrates a rear side view of the crane assembly shown in FIG. 1 with components thereof in a closed/folded position according to aspects of the embodiments.

FIG. 2 illustrates a front side view of crane assembly 100 shown in FIG. 1 with crane portion 128 in an extended condition according to aspects of the embodiments, and FIG. 3 illustrates a similar front side view of crane assembly 100 with crane portion 128 folded and stored within backpack storage area 121 according to aspects of the embodiments. As shown in FIG. 3, hinge assembly 110 has been unlocked to allow horizontal member 108 to fold against vertical member 106, and then the two members 106, 108 have been inserted into backpack storage are 121, along with strings/cables 114*a-d*, platform 116, and handles 118. According to further aspects of the embodiments, prior to folding and storing crane assembly 100 into backpack storage area 121, strings/cables 114 can be retracted into head piece 112. According to further aspects of the embodiments, handles 118*a,b* can be removed and stored in backpack storage area 121 separately, or can be kept attached to strings/cables 114 for storage. According to further aspects of the embodiments, platform 116 can be fashioned to hold two or more containers, or different platforms can be readily interchangeable so that different types of beverage containers can be held in platform 116. According to still further aspects of the embodiments, operation of crane assembly 100 can be performed substantially remotely with the inclusion of a wireless transmitter and receiver pair (Bluetooth, WiFi, infrared, near-field communications, among other types of wireless transmission), one or more small electric motors, a processor and memory, and software code to allow receipt of wirelessly transmitted commands to operate crane assembly 100 in the manner as described herein. Implementation of such wireless transmission/reception systems are known to those of skill in the art, and therefore a more detailed discussion thereof has been omitted in fulfillment of the dual purposes of clarity and precision.

Figure 4:
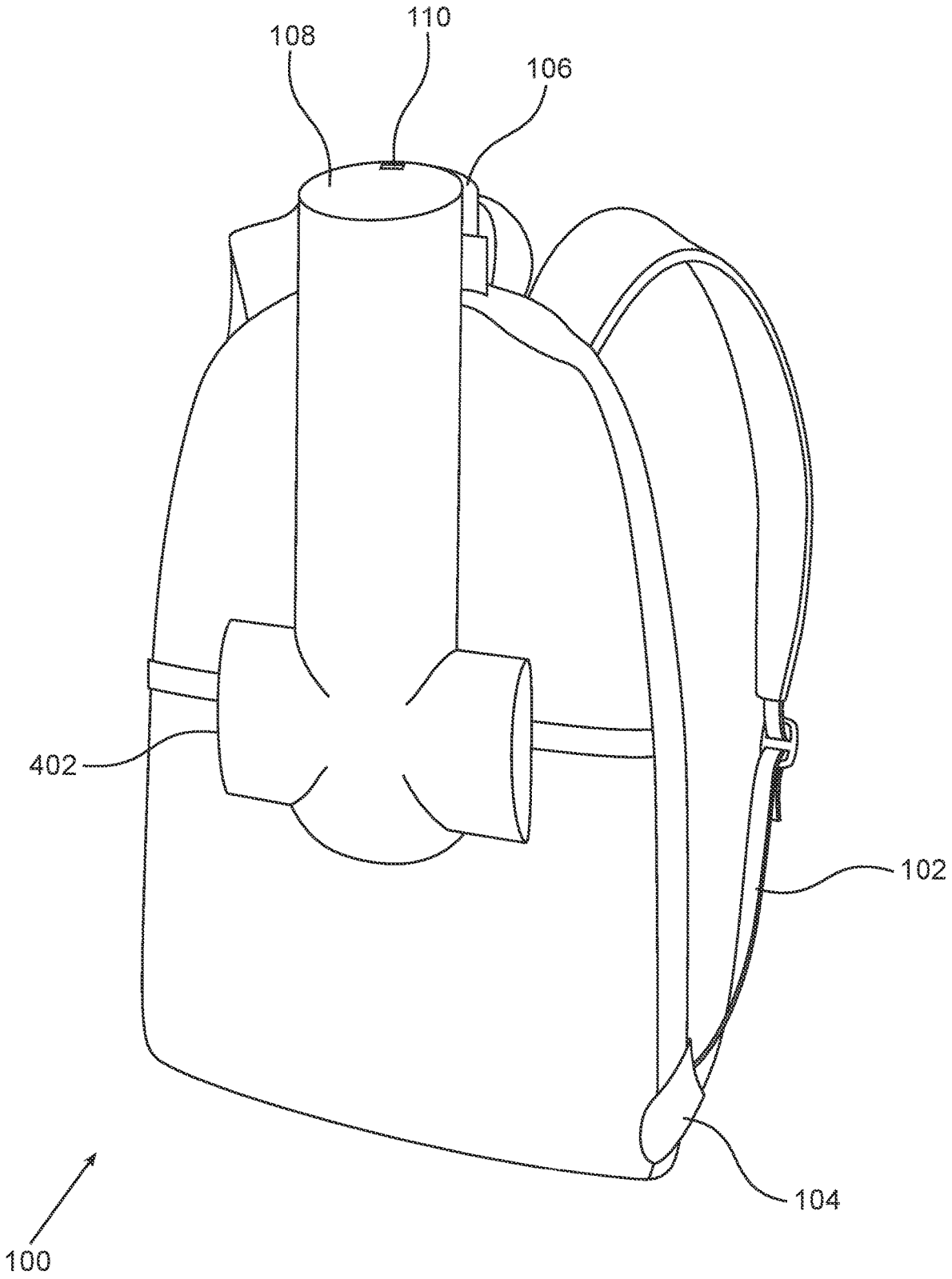
FIG. 4 illustrates a front side view of the crane assembly shown in FIG. 1 with the components in the closed/folded position according to aspects of the embodiments.

FIG. 4 illustrates a front side view of crane assembly 100 shown in FIG. 1 with crane portion 128 in the closed/folded position according to aspects of the embodiments. Also shown in FIG. 4, as part of crane assembly 100, is main logo plate 402 according to aspects of the embodiments. Main logo plate 402 can be used to place an advertisement, or logo, of the beverage being held and retained by crane assembly 100 for the purposes of marketing and advertising. Main logo plate 402 can include the same or different logo/advertisement as logo plate 124 shown in FIG. 1.

Figure 5:
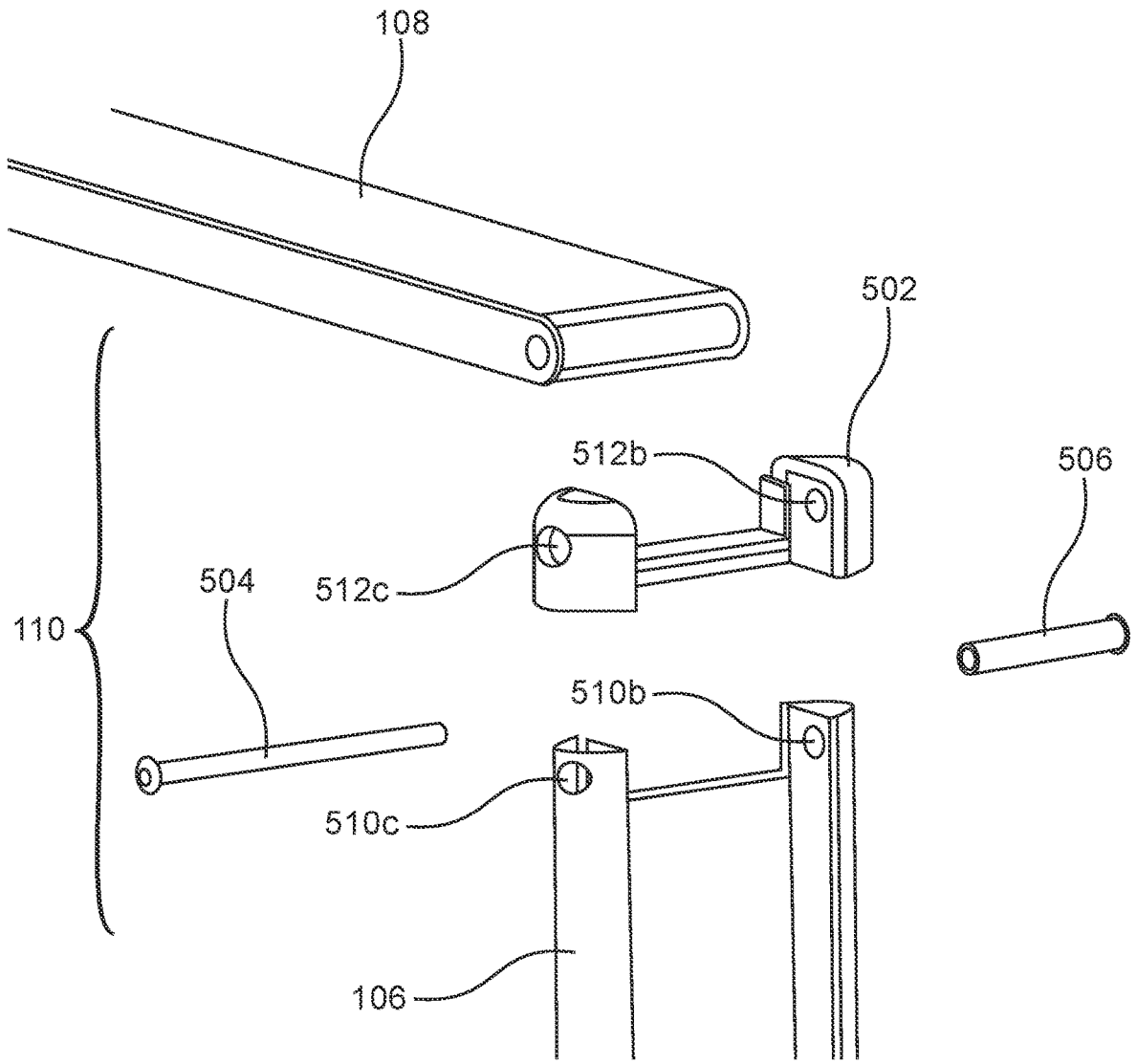
FIG. 5 illustrates a front side view of the crane assembly shown in FIG. 1 with a close-up view of a hinge assembly according to aspects of the embodiments.

FIG. 5 illustrates a front side view of crane assembly 100 shown in FIG. 1 with a close-up view of hinge assembly 110 according to aspects of the embodiments. Hinge assembly 110 comprises joining component 502, threaded bolt 504, threaded bolt sleeve 506, hinge tube 508, vertical member bolt holes 510, and horizontal member bolt holes 512. In assembly, joining component 502 is placed at a first, upper end of vertical member 106, such that joining component bolt holes 512*a,b* are in substantial alignment with vertical member bolt holes 510*a,b*, respectively. A second end of horizontal member 108 that includes hinge tube 508 is then placed within joining component 502, such that tube 508 is in substantial axial alignment with holes 512*a,b*, and holes 510*a,b* and then threaded bolt 504 can be inserted through either side (512*a* and 510*a*, or 512*b* and 510*b*) and then through hinge tube 508 and threaded bolt sleeve 506 can be inserted as well and can threadedly engage with threaded bolt 504 to secure horizontal member 108 to vertical member 106 in a rotatingly but locking fashion. In this arrangement, a user of crane assembly 100 can manipulate horizontal member 108 to rotate using hinge assembly 110 about vertical member 106 in the manner as previously described to stow or use crane assembly 100 according to aspects of the embodiments.

Figure 6:
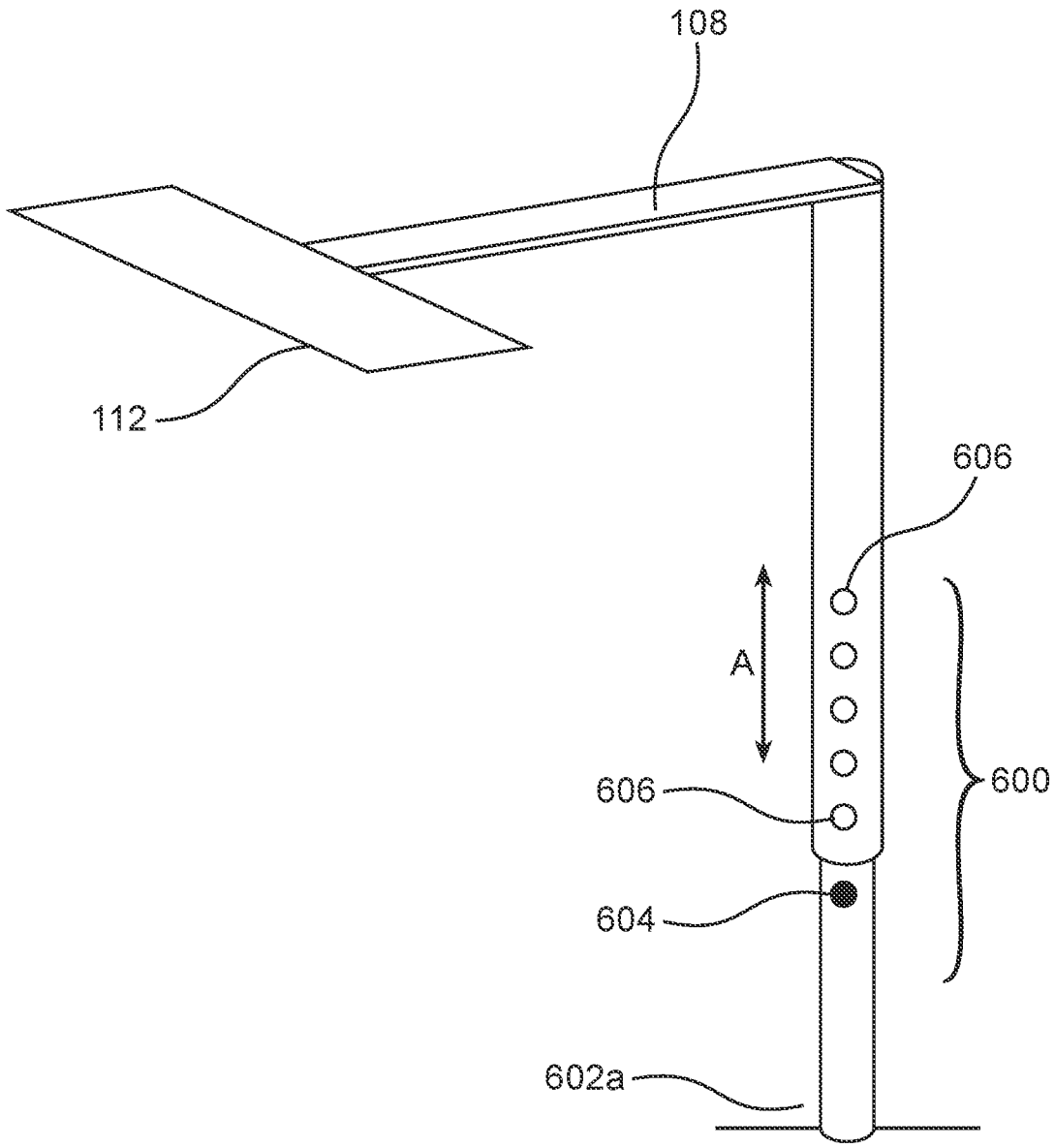
FIG. 6 illustrates an alternate embodiment of a portion of the crane assembly shown in FIG. 1 wherein the vertical member has been replaced by a telescoping mast assembly according to aspects of the embodiments.

FIG. 6 illustrates an alternate embodiment of a portion of crane assembly 100 wherein vertical component 106 has been replaced by telescoping mast assembly 600 according to aspects of the embodiments. In the embodiment shown in FIG. 6, vertical member 106 has been replaced by telescoping mast assembly 600 according to aspects of the embodiments. Telescoping mast assembly (mast assembly) 600 comprises lower mast 602*a* and upper mast 602*b*, spring loaded button assembly (button assembly) 604, and a plurality of button locking holes 606*a-i*. Operation of button assembly 604 is known to those of skill in the art, and therefore, in fulfillment of the dual purposes of clarity and precision a detailed discussion thereof has been omitted from herein; however, a brief description provides an understanding of the use of button assembly 604 in view of the aspects of the embodiments.

Upper mast 602*b* slides over lower mast 602*a* in the directions of Arrow A— that is, either upward to make the assembly higher, or downward to make it lower. Button assembly 604 is attached to an opposite inner wall of lower mast 602*a* (shown and discussed in greater detail in regard to FIGS. 7A and 7B), and button portion 605 is normally extended through hole in lower mast 602*a* so that it can lock through any of holes 606 in upper mast 602*b*.

Figure 7B:
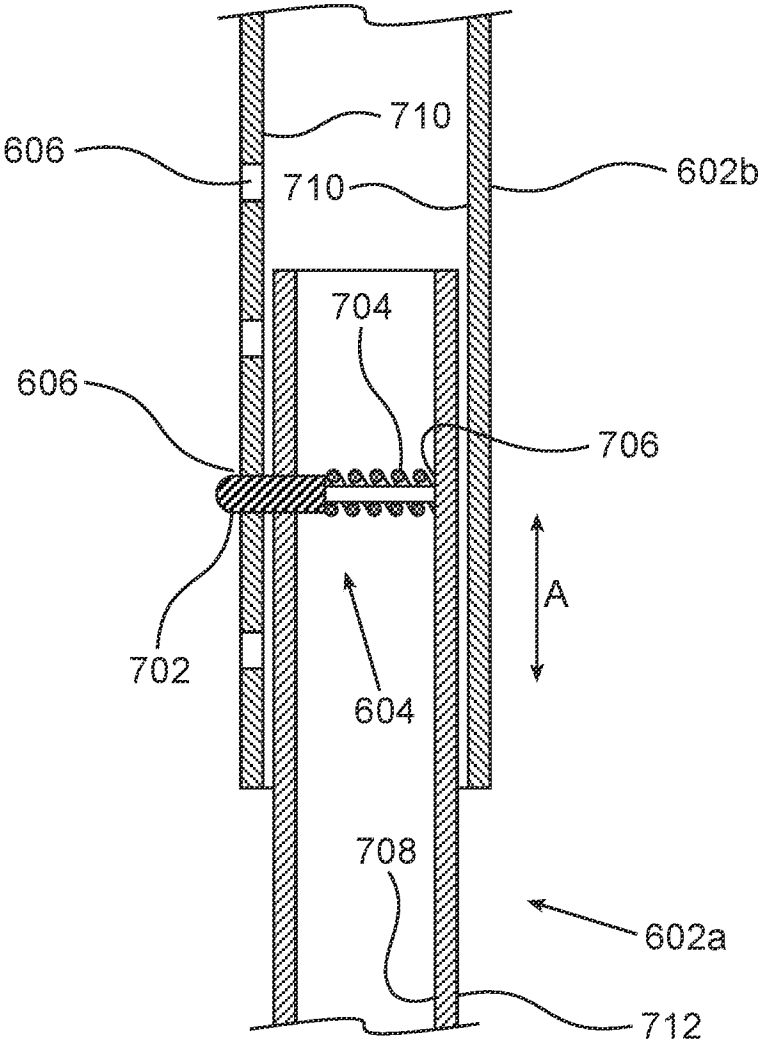
FIG. 7B illustrates a view along lines A-A of FIG. 7A according to aspects of the embodiments.
Figure 7A:
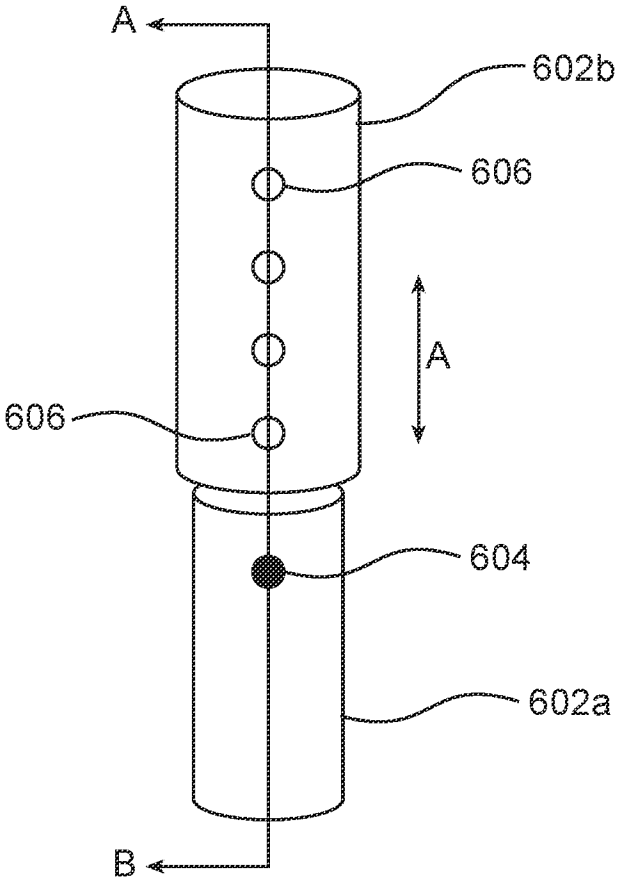
FIG. 7A illustrates an isolated view of portions of an upper mast and lower mast as shown in FIG. 6.

FIG. 7A illustrates an isolated view of portions of upper mast 602*b* and lower mast 602*a* as shown in FIG. 6, and FIG. 7B illustrates a view along lines A-A of FIG. 7A according to aspects of the embodiments.

FIG. 7A illustrates an isolated view of portions of upper mast 602*b*, lower mast 602*a*, and spring-loaded button assembly 604, and FIG. 7B illustrates a view along lines A-A of FIG. 7A according to aspects of the embodiments. Referring to FIG. 7A, it can be seen that upper mast 602*b* slides over lower mast 602*a* in the directions of Arrow A. Button assembly 604 is in substantially vertical alignment with holes 606 of upper mast 602*b*. In FIG. 7B, which is a view along line A-A of FIG. 7A, button assembly 604 is shown to comprise button 702, spring 704, and button post (post) 706. Post 706 is affixed to inner wall 708 of lower mast 602*a*. Button 702 is kept normally extended through operation of spring 704 that is located about post 706, and is compressively fitted between inner wall 708 and button 702. Spring 704 is of such spring constant that it can be relatively easily pushed in against inner wall 708 to force button 702 through one of holes 606 so that upper master 602 can be moved in either direction of Arrow A in FIGS. 6, 7A, and 7B. Outer wall 712 of lower mast 602*a* is frictionally engaged with inner wall 710 of upper mast 602*b* so that the two masts 602*a,b* can move easily with respect to each other.

Figure 9:
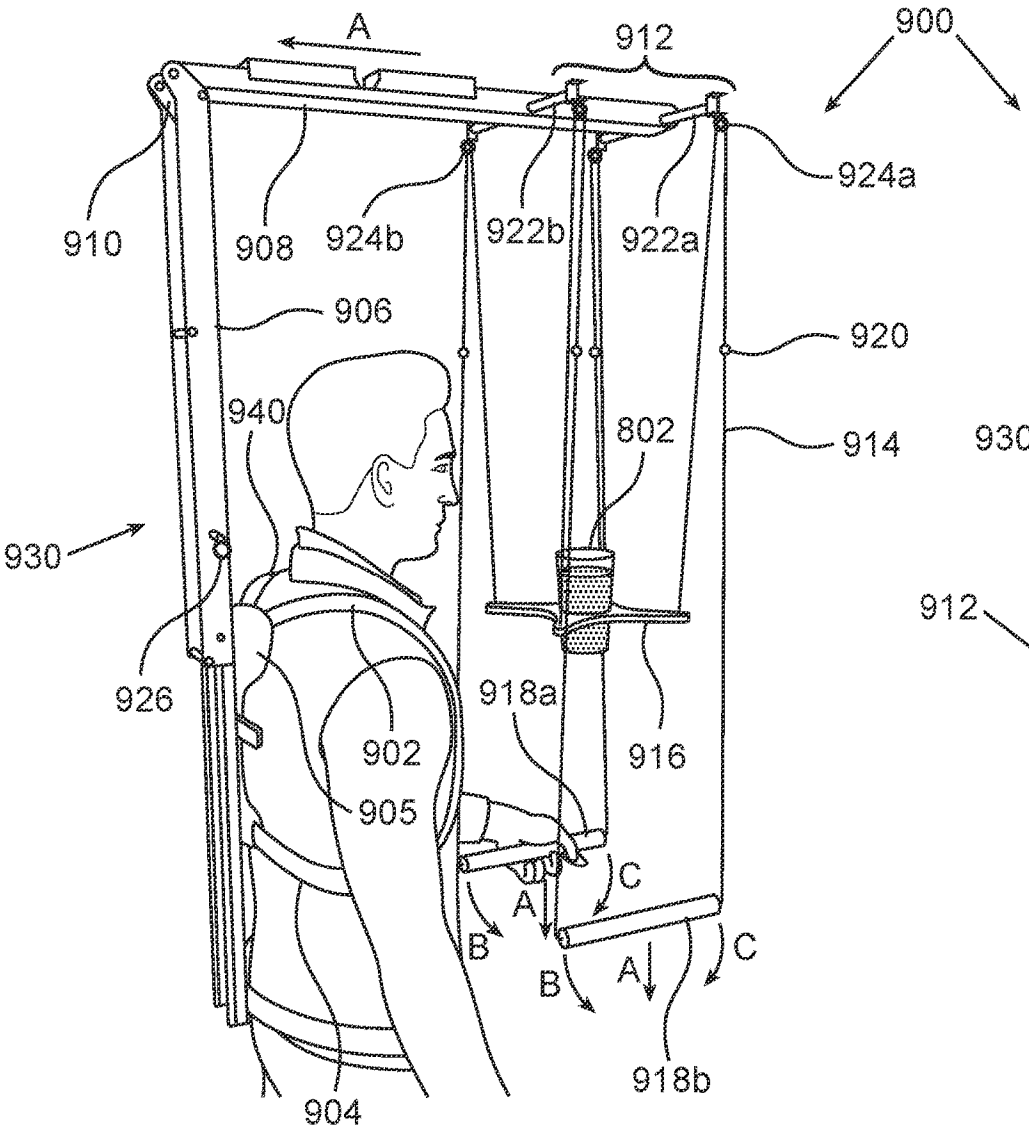
FIG. 9 illustrates a rear side isometric view of a portable crane assembly (crane assembly) adapted to operate as a mechanical adult beverage serving assembly according to further aspects of the embodiments.

FIG. 9 illustrates a rear side isometric view of portable crane assembly (crane assembly) 900 adapted to operate as a mechanical adult beverage serving assembly according to further aspects of the embodiments. Crane assembly 900 is substantially similar to that of crane assembly 100 in terms of functionality, and in the use of some similar components. However, certain components are substantially different than those used in crane assembly 100, as shall be described in detail below.

Figure 10:
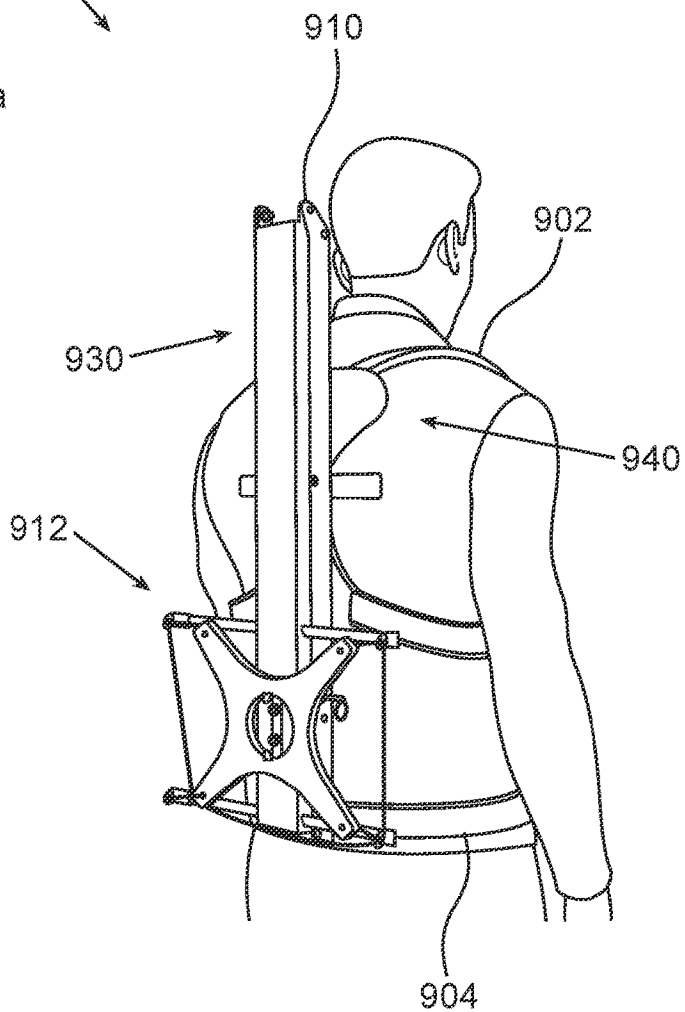
FIG. 10 illustrates a rear side isometric view of the crane assembly shown in FIG. 9 with components thereof in a closed/folded position according to aspects of the embodiments.

FIG. 9 illustrates a rear side isometric view of portable crane assembly (crane assembly) 900 in an extended condition according to aspects of the embodiments, and FIG. 10 illustrates a substantially similar view of crane assembly 900 but in a retracted condition according to aspects of the embodiments. Crane assembly 900 comprises backpack portion 940 and crane portion 930. Backpack portion 940 comprises back support section 905, shoulder straps 902, and waist strap 904, among other components, described below. Crane portion 930 comprises vertical member assembly 906, horizontal member assembly (horizontal member) 908, hinge assembly 910, head piece assembly (head piece) 912, string/cable (cable) 914, platform 916, handles 918, and string stops 920, among other components, described below.

Handles 918 can be manipulated to raise and lower platform 916 according to aspects of the embodiments. Platform 916 is substantially planar in the embodiment shown in FIG. 9, though that need not necessarily be the case. Each handle 918*a,b* is connected to platform 916 by two cables/strings (cables) 914. Each cable 914 that is attached to a respective handle 918 is looped through a respective pulley device 924 and then to platform 916. Pulley device 924 can be a pulley, or, as shown in FIGS. 9, 10, 14, among others, can be an "eye" bolt (essentially a substantially circular loop through which cable 914 can pass substantially frictionally free through). In the embodiments shown in FIGS. 9-16 there are four cables 914: each of which is attached at a first end to a respective end of a handle 918*a,b*. The four cables 914*a-d* pass through respective pulley devices 924*a-d* and then are secured to platform 916 at respective securing points. According to aspects of the embodiments, if all of cables 914*a-d* are substantially similar in length then manipulation of platform 916 is substantially easier, than if they were not all of substantially similar length. According to further aspects of the embodiments, the combination of components of handles 918, pulley device 924 and pulley bar 922 can be referred to as a "pulley assembly." As described below, the pulley assembly can be stored in a storage location located in horizontal member 908.

In operation, a user operates crane assembly 900 by manipulating platform 918 through use of handles 918*a,b* in a substantially similar manner as a marionettist operates a marionette. For example, if a user pulls down handles 918*a,b* in the direction of arrows A as shown in FIG. 9, platform 916 is raised along with whatever container 802 might be in platform 916, along with its contents. To lower platform 916 and container 802 the user lets gravity pull platform 916 and container 802 down by raising their hands holding handles 918*a,b*.

Once the top of the container is at or about the same height as the mouth of the user, the user can pull either or both of handles 918*a,b* in the direction of Arrows B so that the container is tilted into the mouth of the user, and the beverage contained therein is poured out. Alternatively, if the user were to pull handles 918*a,b* in the direction of Arrows C, the user could pour the contents of the container into the mouth of a person standing in front of the user, or into some other container. By way of a further non-limiting example, the user could raise (or lower) platform 916 to a desired height, and pull-down handle 918*b* in the direction of Arrow A so that container 802 is tilted to the right of the user, and visa-versa pull down handle 918*a* so that container 802 is tilted to the left of the user. Substantially any angle of tilt can be accomplished by the appropriate application of downward force on one or both of handles 918*a,b*, according to aspects of the embodiments. According to aspects of the embodiments, the user can tilt platform 916 at substantially any angle between about 0° and about 180°. Thus, the user can manipulate handles 918*a,b* to control movement of platform 916 much like a marionettist would do with a marionette.

FIGS. 8A and 8B illustrate beverage container grasping mechanism 800 that can used in place of platform 916 shown in FIGS. 9 and 10 for retaining a beverage filled container 802 according to aspects of the embodiments. In fulfillment of the dual purposes of clarity and precision, in that grasping mechanism 800 has been described in detail in regard to crane assembly 100 and the functionality of grasping mechanism 800 remains substantially similar in regard to its use with crane assembly 900, a further detailed discussion thereof has been omitted from herein.

Referring back to FIG. 9, crane portion 930 deploys from backpack portion 940 according to aspects of the embodiments. Vertical member assembly 906 extends from an exterior portion of backpack support area 905, and connects to horizontal member 908 via hinge assembly 110 at a second end of vertical member assembly 906. Horizontal member 908 cantilevers over the top of the head and shoulders of the user. At a second end of horizontal member 908 is head piece 912 that supports a plurality of cables 914*a-d*. Cables 914*a-d* pass through respective components of head piece 912 and can slide substantially freely through head piece 912. As shown in FIGS. 9 and 10, and described in greater detail below, an eye-bolt can be used to facilitate the movement of cables 914*a-d* through head piece 912. Attached to a first end of cables 914*a-d*, substantially directly below head piece 912, is platform 916. Platform 916 is specially designed to securely hold container 802 (not shown in FIGS. 9 and 10). Container 802 can be a bottle, can, or open cup, and can contain a beverage, such as beer. Attached to a second end of cables 914*a-d* are first and second handles 918*a,b* that can be pulled to manipulate the position of platform 916—i.e., to raise, lower, and/or tilt platform 916. Located on one or more of cables 914*a-d* are stops 920 that prevent them from passing too far through head piece 912.

Located at a junction of a first end of horizontal member 908 and the second end of vertical member assembly 906 is hinge assembly 910. Hinge assembly 910 hingedly joins vertical member assembly 906 and horizontal member 908 together. Crane portion 930 is adapted to fold for storage and transport through use of hinge assembly 910 according to aspects of the embodiments. A detailed view of hinge assembly 910 is shown in FIG. 14, and discussed in detail below. Vertical member assembly 906 is height adjustable via a pin and lock system, among other types of releasably securing mechanisms.

FIG. 10 illustrates a similar front side isometric view of crane assembly 900 as shown in FIG. 9; however, in FIG. 10, crane assembly 900 has been folded and stored against backpack portion 940 according to aspects of the embodiments. In FIG. 10 the user has first pulled down handles 918*a-d* to bring platform 916 up against head piece 912.

The user then rolls up strings/cable 914 and places rolled up string/cable 914 along with handles 918*a,b* into the channel of horizontal member 908 and can secure them with a plastic hook and loop securing device (shown in FIG. 14). After string/cable 914 and handles 918*a-d* have been secured, horizontal member 908 can be rotated in the direction of Arrow A shown in FIG. 9. Securing mechanism 926 (discussed in greater detail below in regard to FIG. 14) can be removed/released that allows vertical member assembly 906 and horizontal member 908 to retract downwards and against back support portion 905. Folding and storing of crane assembly 100 is discussed in greater detail below in regard to FIG. 14.

According to further aspects of the embodiments, platform 916 can be fashioned to hold two or more containers, or different platforms 916*a,b* can be readily interchangeable so that different types of beverage containers can be held in platform 916. According to still further aspects of the embodiments, operation of crane assembly 900 can be performed substantially remotely with the inclusion of a wireless transmitter and receiver pair (Bluetooth, WiFi, infrared, near-field communications, among other types of wireless transmission), one or more small electric motors, a processor and memory, and software code to allow receipt of wirelessly transmitted commands to operate crane assembly 900 in the manner as described herein. Implementation of such wireless transmission/reception systems are known to those of skill in the art, and therefore a more detailed discussion thereof has been omitted in fulfillment of the dual purposes of clarity and precision.

Figure 11:
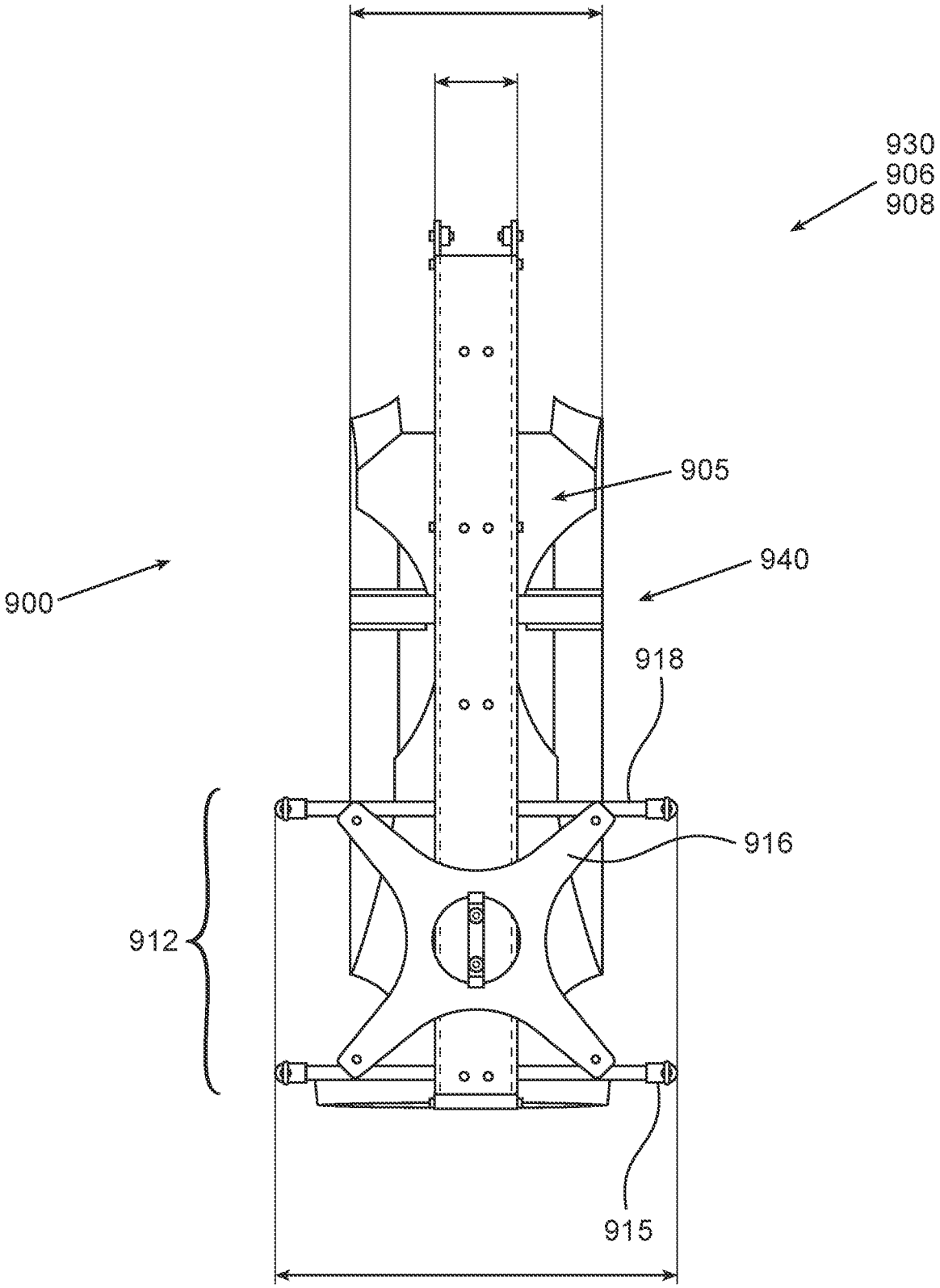
FIG. 11 illustrates a front view of the crane assembly as shown in FIG. 9 in a folded position.
Figure 12:
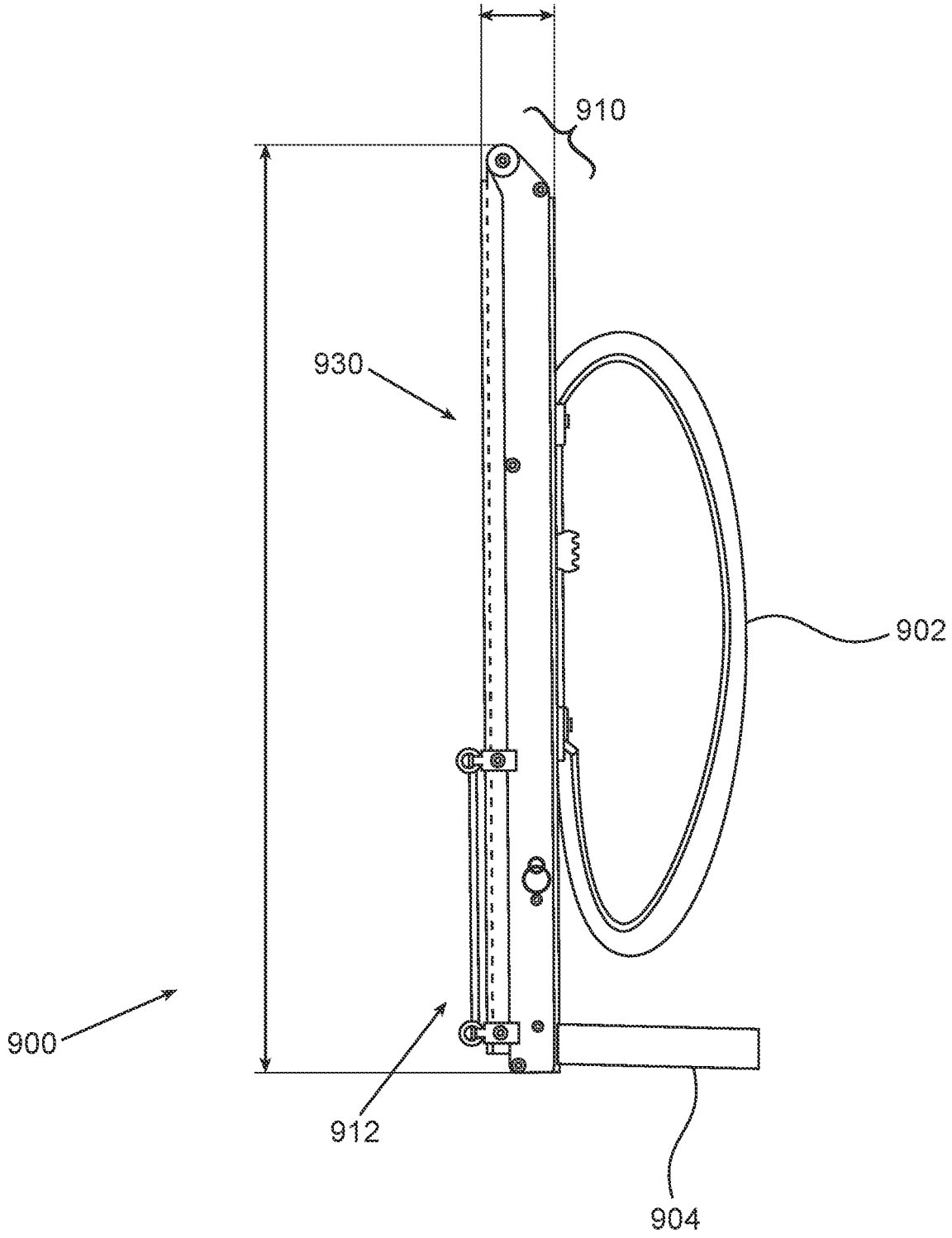
FIG. 12 illustrates a right-side view of the folded crane assembly.
Figure 13:
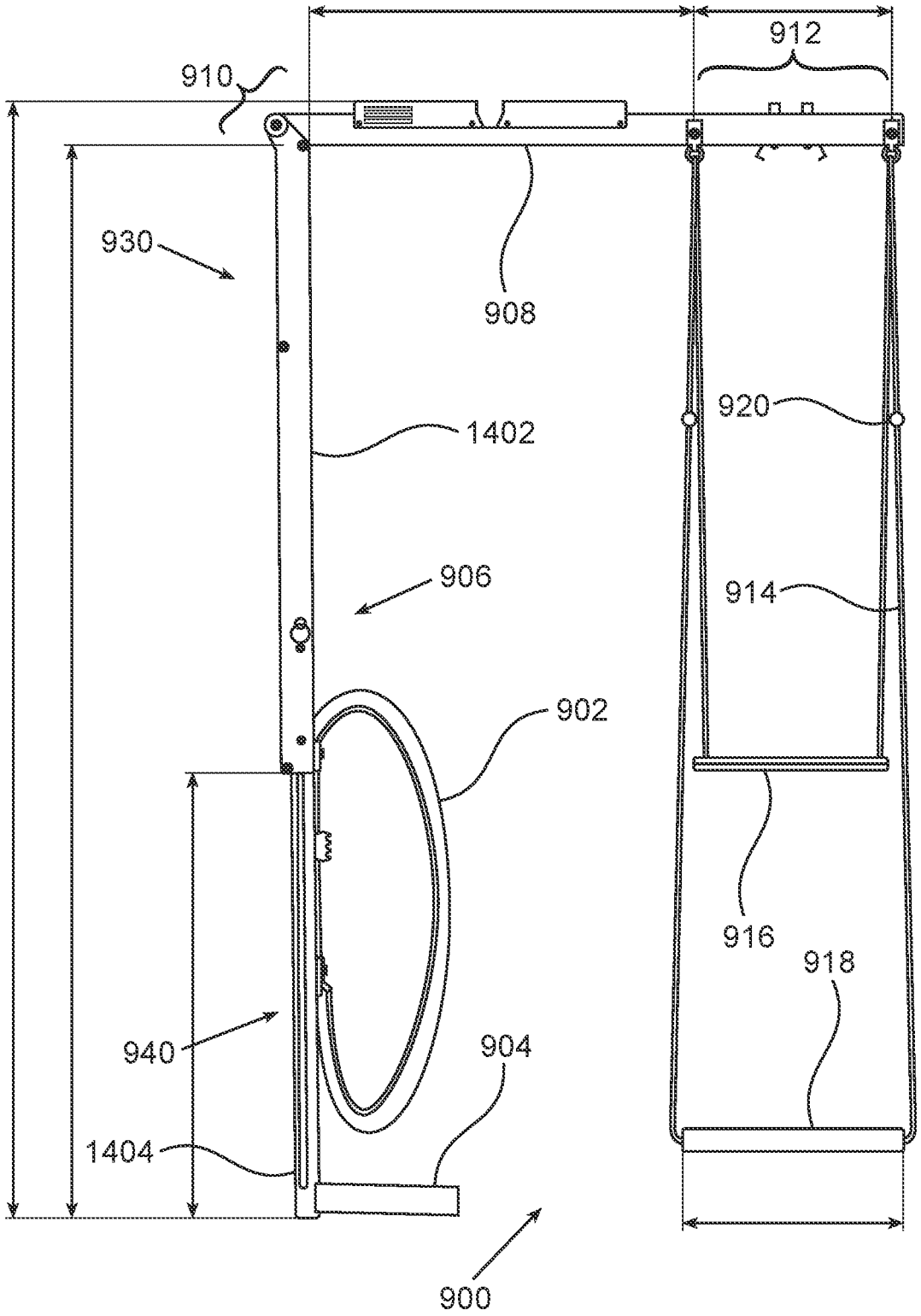
FIG. 13 illustrates a right-side view of an extended crane assembly according to aspects of the embodiments.
Figure 14:
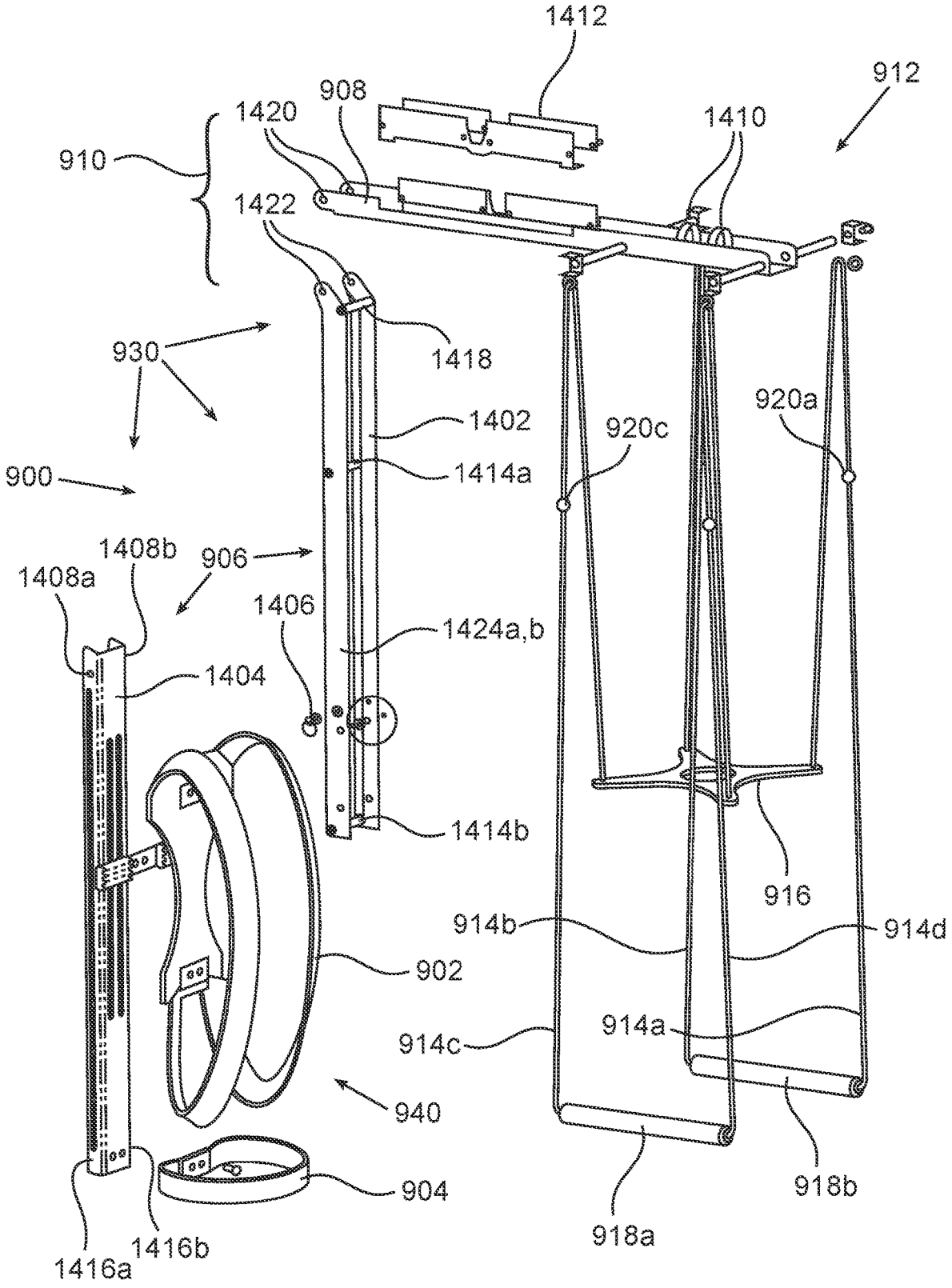
FIG. 14 illustrates a front left isometric exploded view of an extended crane assembly as shown in FIG. 9 according to aspects of the embodiments.

FIG. 11 illustrates a front view of folded crane assembly 900, FIG. 12 illustrates a right-side view of folded crane assembly 900, and FIG. 13 illustrates a right-side view of extended crane assembly 900 according to aspects of the embodiments. \

FIG. 14 illustrates a front left isometric exploded view of extended crane assembly 900 as shown in FIG. 9 according to aspects of the embodiments. Several components are visible in FIG. 14 not discussed above. These include upper vertical member 1402, lower vertical member 1404, securing mechanism (which can be a spring loaded plunger) 926, lower vertical member securing hole 1408, retaining mechanism 1410, logo plate 1412, slide bars 1414*a,b*, slide channels 1416*a,b*, and rotation stop bar 1418. Each will now be discussed in greater detail.

As described above, crane portion 930 comprises, in part, horizontal member 908, hinge assembly 910, head piece 912, vertical member assembly 906, among other components. Vertical member assembly 906 comprises, in part, upper vertical member 1402, and lower vertical member 1404. Horizontal member 908 comprises logo plate 1412 that displays a logo or advertisement of a manufacturer of an adult or other type of beverage that can be carried by crane assembly 100 according to aspects of the embodiments. Further, as discussed above, horizontal member comprises first and second retaining mechanisms 1410, which can be in the form of plastic hook and loop mechanisms that can be repeatedly used to store handles 918 and string/cable 914 according to aspects of the embodiments. Hinge assembly 910 comprises, in part, first set of rotating holes 1420 located at a first end of horizontal member 908 and second set of rotating holes 1422 located at a first end of upper vertical member 1402 that can be co-axially aligned and secured by a bolt (not shown) to allow horizontal member 908 to rotate about the bolt between a fully extended position (as shown in FIGS. 9 and 14) and a stored condition as shown in FIG. 10. When fully extended, horizontal member 908 rests upon rotation stop bar 1418, which is also a part of hinge assembly 910.

To assembly vertical member assembly 906, upper vertical member 1402 is slidingly engaged with lower vertical member 1404 via first and second slide bars 1414*a,b* (located on upper vertical member 1402) that fit within first and second slide channels 1416 (located on lower vertical member 1404). To secure upper vertical member in a fully vertically extended position, securing mechanism 926 can be removably and fixedly engaged with lower vertical member securing holes 1408*a,b* and upper vertical member securing holes 1424*a,b* according to aspects of the embodiments.

Figure 15:
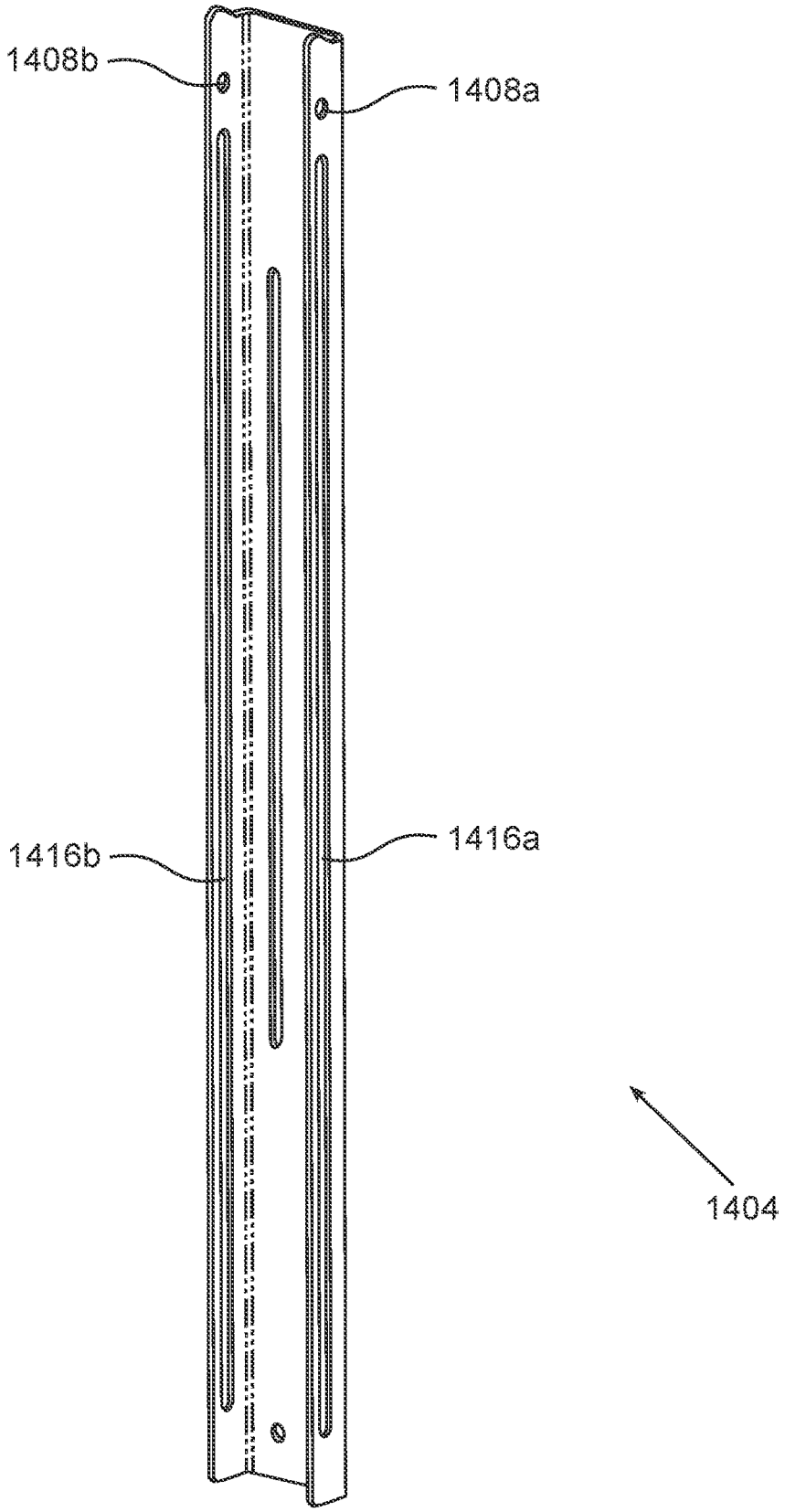
FIG. 15 illustrates a front isometric view of a lower vertical member shown in FIG. 14 according to aspects of the embodiments.
Figure 16:
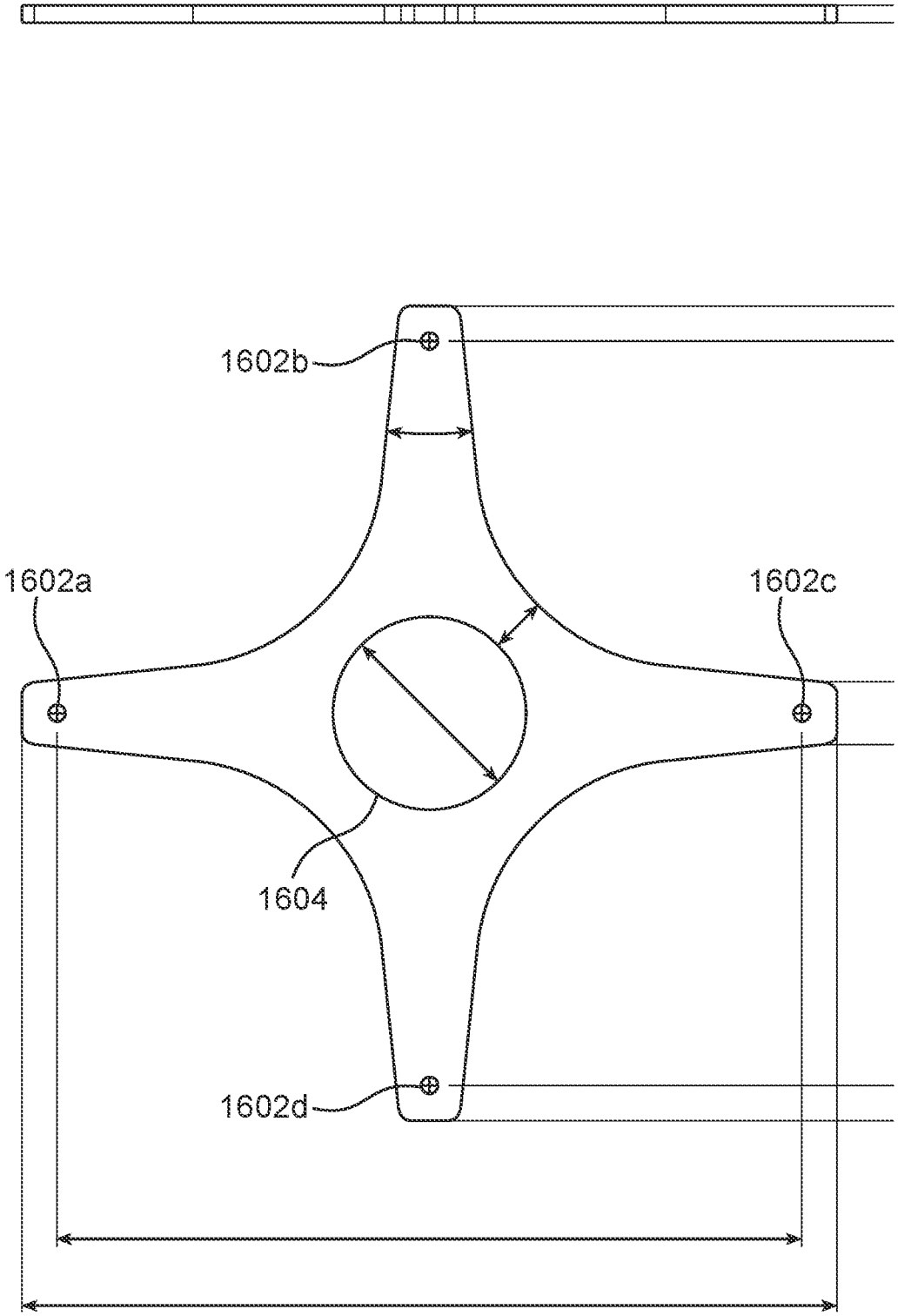
FIG. 16 is a top plan view of the platform shown in FIGS. 9 and 14 according to aspects of the embodiments.

FIG. 15 illustrates a front isometric view of lower vertical member 1404 according to aspects of the embodiments, and FIG. 16 is a top plan view of platform 916, showing string/cable holes 1602*a-d*, and beverage container hole 1604 according to aspects of the embodiments.

FIG. 17 is a flow chart of method 1700 for using crane assembly 100, 900 as shown in FIGS. 1-16 according to aspects of the embodiments. It is to be noted that not all of the method steps discussed in regard to FIG. 17 and method 1700 need to be performed to use crane assembly 100, 900, or the order of the steps can be interchanged in some cases, according to aspects of the embodiments.

In method step 1702, the user can insert a container into platform 116, 916.

In method step 1704, the user can fill the container with a beverage (or, as discussed above, the container can already be filled with a beverage).

In method step 1706, the user can adjust the height of platform 116,916 to a desired height by pulling on or released handles 118*a,b*, 918*a,b* as appropriate, in the manner described above.

In method step 1708 the user can manipulate handles 118*a,b*, 918*a,b* to cause the beverage filled container to tilt into a mouth of the user or other person or another device, as desired.

Aspects of the embodiments can be formed of aluminum, stainless steel, polyurethane, polycarbonate, or any other variations known in the art.

The manufacturing method can make use of injection molding, rotational molding, compression molding, die casting, laser cutting, 3D printing, or any other variations known in the art.

As discussed in regard to FIGS. 1-8, reference is made to several dimensions, including several radii, angles, height, among others. Those of skill in the art can appreciate that although examples of dimensions are provided, these should not be taken in a limiting manner; that is, the aspects of the embodiments are not to be construed as defined or limited by the specific example of the dimensions shown and discussed, but instead are provided merely for illustrating an example of what a device that incorporates the aspects of the embodiments could, in a non-limiting manner, look like. Furthermore, as those of skill in the art can appreciate, since the aspects of the embodiments are directed towards a physical object, with dimensional characteristics, all of the parts will have various dimensions, some of which are not shown in fulfillment of the dual purposes of clarity and brevity. According to still further aspects of the embodiments, some of these objects will have dimensional characteristics that lend themselves to aesthetic aspects; in fulfillment of the dual purposes of clarity and brevity, dimensions in this regard have also been omitted. Therefore, as the aspects of the embodiments are directed towards implantation and use of crane assembly 100, it is to be understood that the dimensions of the different objects, some dimensions shown, some dimensions not shown, will be understood by those of skill in the art.

The disclosed embodiments provide a system, and a method for [summary of the invention; paraphrase or copy from summary] It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

All United States patents and applications, foreign patents, and publications discussed above are hereby incorporated herein by reference in their entireties.

INDUSTRIAL APPLICABILITY

To solve the aforementioned problems, the aspects of the embodiments are directed towards systems, methods, and modes for marketing and advertising beer through the use of a mechanical beer drinking assembly according to aspects of the embodiments.

ALTERNATE EMBODIMENTS

Alternate embodiments may be devised without departing from the spirit or the scope of the different aspects of the embodiments.

The invention claimed is:

1. A beverage carrying assembly, comprising:
a backpack adapted to be worn by a user;
a frame, the frame comprising:
a first portion to be affixed to the backpack; and
a second portion that projects over the head of the user;
a platform adapted to carry a beverage container; and
a pulley assembly adapted to manipulate a position of the platform with respect to the user and frame,
wherein the backpack comprises:
a back portion that, when the backpack is worn by the user, is adjacent to a back of the user;
a pair of shoulder straps; and
a waist strap, the shoulder straps and waist strap adapted to retain the backpack to an upper torso of the user,
wherein the first portion of the frame comprises a first member affixed to a rear surface of the back portion of the backpack and is adapted to be substantially vertical,
wherein the second portion of the frame comprises a second member affixed to the first member and is substantially orthogonal to the first member and extends over a head of the user, and
wherein the frame is adapted to be changeable between a stored condition and an extended condition.

2. The beverage carrying assembly according to claim 1, wherein
the platform is adapted to retain a beverage container.

3. The beverage carrying assembly according to claim 2, wherein
the beverage is an alcoholic beverage.

4. The beverage carrying assembly according to claim 2, wherein
the platform is substantially planar with a hole adapted to retain the beverage container.

5. The beverage carrying assembly according to claim 2, wherein the platform comprises:
a back portion; and
two or more curved rods, each of which is curved to substantially match a shape of the beverage container, and opposedly attached to the back portion via respective springs such that each of the curved rods can be pulled away from each other, the beverage container located therebetween, and the curved rods released to secure the beverage container between the curved rods.

6. The beverage carrying assembly according to claim 1, wherein
the second member is rotatingly attached to a second end of the first member at a first end of the second member.

7. The beverage carrying assembly according to claim 6, wherein
the second member is adapted to rotate about the first member between the stored condition and the extended condition, and when in the stored condition, the second member is in substantial alignment with the first member, and further wherein, when the first and second member are in substantial alignment with each other, the first and second member can be secured to the back portion of the backpack.

8. The beverage carrying assembly according to claim 1, wherein the pulley assembly is adapted to be stored within the second member, and the pulley assembly is adapted to be retained when stored within the second member by a retaining mechanism.

9. The beverage carrying assembly according to claim 8, wherein the retaining mechanism comprises:

a plastic hook and loop device.

10. The beverage carrying assembly according to claim 1, wherein the first member comprises:

an upper portion;

a lower portion;

a rotation stop bar located at a first end of the upper portion;

a pivot bar adapted to affix the first member to the second member, and is further adapted to facilitate rotation of the second member about the first member, and wherein the rotation stop bar prevents rotation of the second member about the first member when the second member is substantially orthogonal to the first member;

a first and second slide channel in the lower portion;

a first and second sliding slide bar in the upper portion adapted to fit through the first and second slide channel in the lower portion, such that the upper portion can slide up and down the lower portion.

11. The beverage carrying assembly according to claim 1, wherein the first member comprises:

an upper portion comprising a plurality of upper portion holes, substantially aligned with each other;

a lower portion adapted to slidingly engage within the upper portion, the lower portion comprising:

a button hole, in substantial alignment with the plurality of upper portion holes;

a spring loaded button assembly affixed to an inner wall opposite to that of the button hole, the button hole adapted to allow a button portion of the spring loaded button assembly to move in and out through the button hole as a user pushes against a spring of the spring loaded button assembly and stops pushing against the spring, and wherein the button can move in and out of any one of the upper portion holes when the upper portion and lower portion are moved relative to each other so that any one of the upper portion holes is in substantial alignment with the button hole, and when the button extends through a first upper portion hole and button hole, the upper portion and lower portion are substantially but releasably fixed in position with respect to each other, and when the button is pushed through the aligned upper portion hole and button hole, the upper and lower portions can be moved relative to each other.

12. The beverage carrying assembly according to claim 1, wherein the pulley assembly comprises:

a first and second handle;

a first cable attached to the first handle at a first end of the first cable and a first end of the first handle;

a second cable attached to the first handle at a first end of the second cable and a second end of the first handle;

a third cable attached to the second handle at a first end of the third cable and a first end of the second handle;

a fourth cable attached to the second handle at a first end of the fourth cable and a second end of the second handle;

a first pulley bar attached to the second member;

a second pulley bar attached to the second member;

a first pulley device attached to a first end of the first pulley bar;

a second pulley device attached to a first end of the second pulley bar;

a third pulley device attached to a second end of the first pulley bar; and a fourth pulley device attached to a second end of the second pulley bar, and wherein the first cable passes through the first pulley device and is attached to the platform at a second end of the first cable, the second cable passes through the second pulley device and is attached to the platform at a second end of the second cable, the third cable passes through the third pulley device and is attached to the platform at a second end of the third cable, and the fourth cable passes through the fourth pulley device and is attached to the platform at a second end of the fourth cable.

13. The beverage carrying assembly according to claim 1, wherein the pulley assembly is further adapted to change a height of the platform, and is still further adapted to tilt the platform at substantially any angle between about 0° and about 180°, and in substantially any direction.

* * * * *